US007028852B2

(12) United States Patent
Johnson et al.

(10) Patent No.: US 7,028,852 B2
(45) Date of Patent: Apr. 18, 2006

(54) MERCHANDISING SYSTEM

(75) Inventors: Allen E. Johnson, Hartford, WI (US); M. Scott Bryson, Brookfield, WI (US)

(73) Assignee: DCI Marketing, Inc., Milwaukee, WI (US)

( * ) Notice: Subject to any disclaimer, the term of this patent is extended or adjusted under 35 U.S.C. 154(b) by 18 days.

(21) Appl. No.: 10/132,662

(22) Filed: Apr. 25, 2002

(65) Prior Publication Data

US 2002/0170866 A1 Nov. 21, 2002

Related U.S. Application Data

(60) Provisional application No. 60/286,892, filed on Apr. 26, 2001, provisional application No. 60/313,894, filed on Aug. 21, 2001, provisional application No. 60/335,924, filed on Oct. 31, 2001, provisional application No. 60/329,656, filed on Oct. 15, 2001.

(51) Int. Cl.
*A47F 7/00* (2006.01)

(52) U.S. Cl. ..... 211/59.3; 211/175; 211/184; 108/60; 312/71

(58) Field of Classification Search ..... 211/59.3, 211/59.2, 175, 184, 74; 108/60, 61; 312/61, 312/71, 75, 45
See application file for complete search history.

(56) References Cited

U.S. PATENT DOCUMENTS 2,652,154 A 9/1953 Stevens
4,685,574 A * 8/1987 Young et al. ..... 211/59.2
4,724,968 A 2/1988 Wombacher
4,762,236 A * 8/1988 Jackle et al. ..... 211/59.3
4,830,201 A * 5/1989 Breslow ..... 211/184
4,901,869 A * 2/1990 Hawkinson et al. ..... 211/59.3
5,069,349 A * 12/1991 Wear et al. ..... 211/59.3
5,097,962 A 3/1992 Eklof et al.
5,199,584 A * 4/1993 Fowler et al. ..... 211/184
5,490,600 A * 2/1996 Bustos ..... 211/187
5,542,552 A 8/1996 Yablans et al.
5,577,623 A * 11/1996 Bustos ..... 211/187
5,634,564 A * 6/1997 Spamer et al. ..... 211/59.3
5,638,963 A * 6/1997 Finnelly et al. ..... 211/59.3
5,685,664 A 11/1997 Parham et al.
5,788,091 A 8/1998 Robertson et al.
5,839,588 A * 11/1998 Hawkinson ..... 211/59.3
6,041,720 A * 3/2000 Hardy ..... 108/60
6,105,791 A * 8/2000 Chalson et al. ..... 211/59.3
6,129,218 A * 10/2000 Henry et al. ..... 211/59.3

(Continued)

*Primary Examiner*—Jennifer E. Novosad
(74) *Attorney, Agent, or Firm*—Foley & Lardner LLP

(57) ABSTRACT

A system and method for providing a merchandising system. The merchandising system includes a first divider, a second divider, and a third divider. The merchandising system further includes a first connector and a second connector. The first connector couples the first divider and the second divider. The first connector provides for selective size adjustability between the first divider and the second divider. The second connector couples the second divider and the third divider. The second connector provides for selective size adjustability between the second divider and the third divider. The connector may be provided in a variety of configurations, including teeth configured to engage with the divider. The connector may alternatively include a flexible member configured to engage and disengage with the divider.

85 Claims, 40 Drawing Sheets

U.S. PATENT DOCUMENTS 6,168,032 B1 * 1/2001 Merl ..... 211/59.2
6,227,385 B1 * 5/2001 Nickerson ..... 211/59.3
6,311,852 B1 * 11/2001 Ireland ..... 211/59.2
6,409,028 B1 6/2002 Nickerson
6,571,498 B1 * 6/2003 Cyrluk ..... 40/661.03
6,585,120 B1 7/2003 Robertson
6,622,874 B1 * 9/2003 Hawkinson ..... 211/59.3
2003/0085187 A1 5/2003 Johnson et al.

* cited by examiner

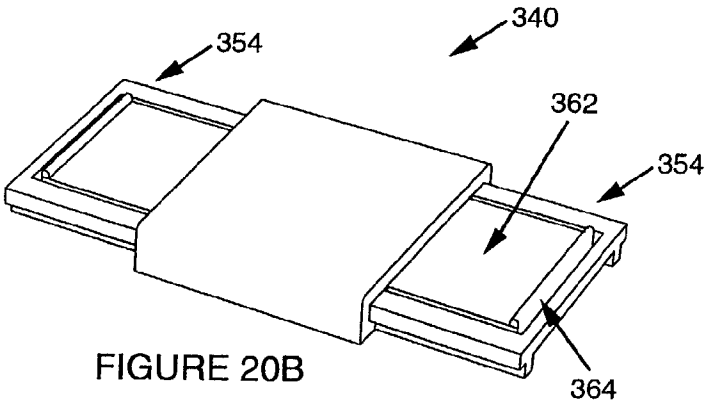
FIGURE 20B
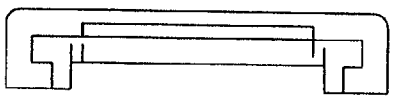
FIGURE 20D
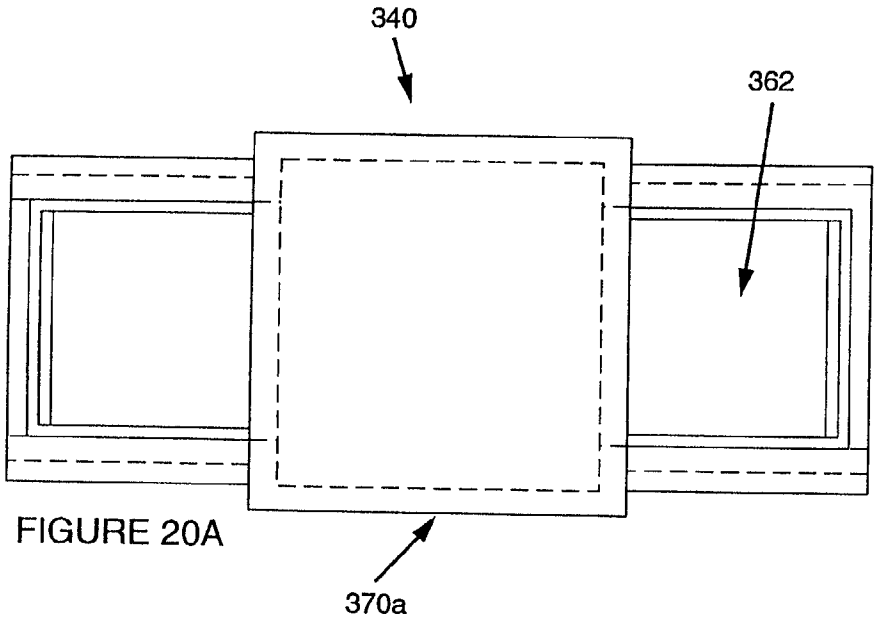
FIGURE 20A
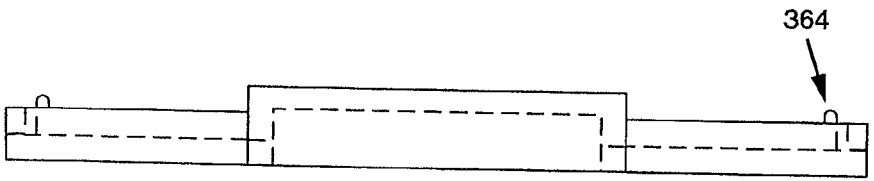

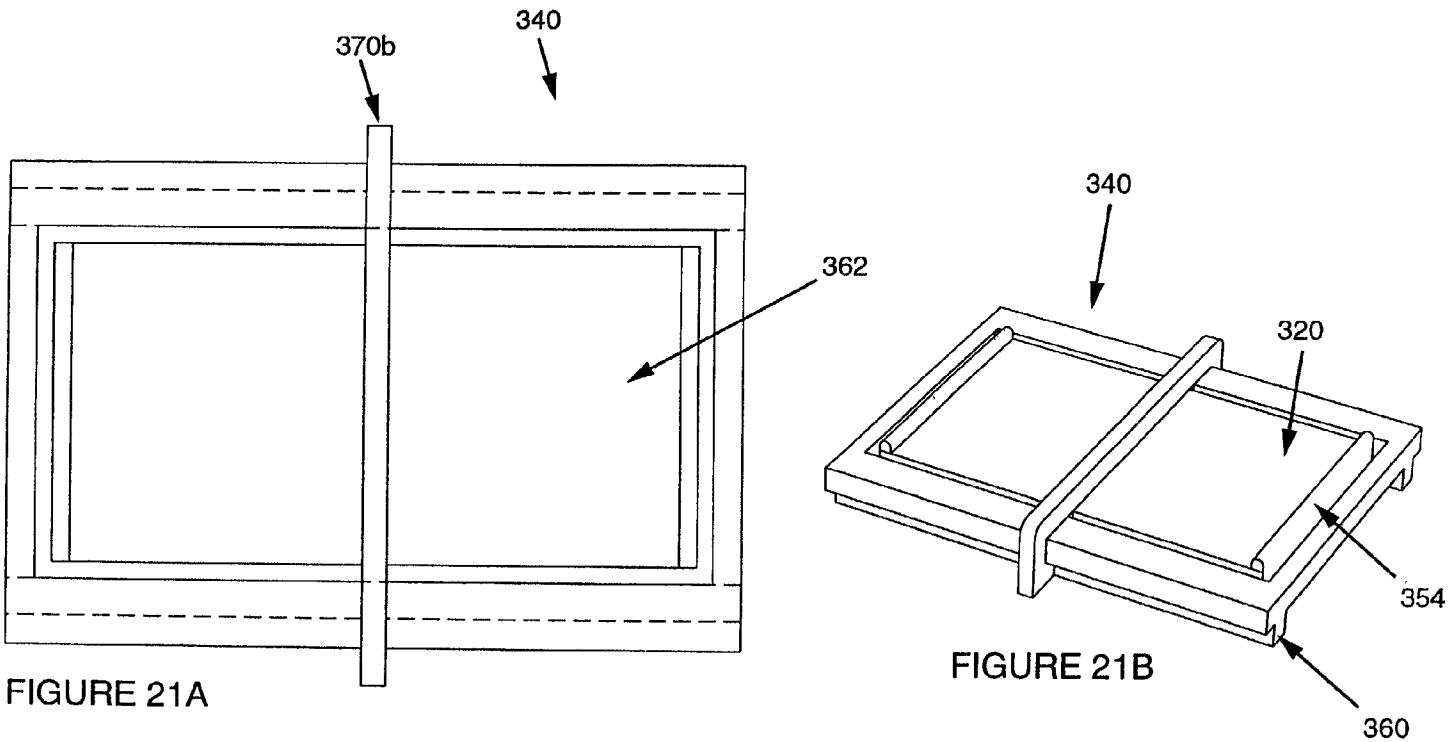
FIGURE 21A
FIGURE 21B
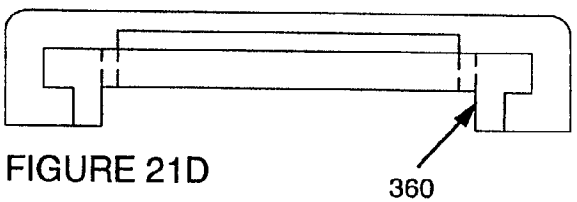
FIGURE 21D
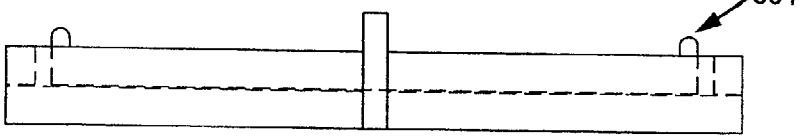
FIGURE 21C

MERCHANDISING SYSTEM

CROSS-REFERENCE TO RELATED PATENT APPLICATIONS

The present application claims the benefit of the following U.S. patent applications under 35 U.S.C. § 119: (1) U.S. Provisional Patent Application No. 60/286,892 ("DIVIDER SYSTEM FOR SHELF OR THE LIKE") filed Apr. 26, 2001; (2) U.S. Provisional Patent Application No. 60/313,894 ("SHELF DIVIDER SYSTEM") filed Aug. 21, 2001; (3) U.S. Provisional Patent Application No. 60/335,924 ("MERCHANDISING SYSTEM") filed Oct. 31, 2001; and (4) U.S. Provisional Patent Application No. 60/329,656 ("MERCHANDISING SYSTEM") filed Oct. 15, 2001. The disclosures of each of these applications is incorporated in the present application by reference.

BACKGROUND

The present inventions relate to a merchandising system. The present inventions more specifically relate to a merchandising system, of a type having a divider system or shelf system providing for the selective adjustment of the width or spacing of a shelf division or divisions.

It is known to provide a merchandising system on a shelf of a shelving unit so that some type of product or merchandise may be stocked and presented to potential customers in a more orderly or organized manner. According to one known arrangement, a merchandising system will provide several dividers attached to a single front connection piece. The dividers may be adjusted, allowing for the system to accommodate variously sized products. However, in this arrangement, when one display area or "facing" needs to be adjusted, adjacent facings in the system will also have to be adjusted in order to accommodate the same sized product in adjacent facings. As a result, adjustments of the systems tend to become more involved, even to resize only one product facing, because it may be necessary to resize or adjust other (or all) of the facings in the system. Also, adjustments in this arrangement become more involved as the number of dividers increase. In way of example, one known arrangement may be provided on a shelf, the arrangement having fifteen dividers forming fourteen facings. Should one facing require adjustment to accommodate a product of different size, all the remaining facings will also require adjustment in order to keep the same relative spacing of the facings. As a result, these systems may require an increased amount of time and/or effort in order to resize or reconfigure a merchandising system when products and product sizes change.

It would be advantageous to provide a merchandising system that would allow for independent adjustment of a division (which may be a display area, "facing," cell, compartment, etc.) without requiring adjustment of adjacent divisions within the system. It would also be advantageous to provide a merchandising system in which the size of one division could be enlarged or reduced without enlarging or reducing the size of an adjacent division. It would further be advantageous to provide a merchandising system with divisions that are conveniently and selectively adjustable in size or shape. It would further be advantageous to provide a merchandising system that provides for the selective movement of a divider to discrete locations. It would further be advantageous to provide a merchandising system that provides for modularity in the construction and assembly of the merchandising system. It would further be advantageous to provide a merchandising system that could be installed on a shelf or shelving unit. It would further be advantageous to provide a merchandising system that would allow for a relatively simple connection between two divider panels. It would further be advantageous to provide a merchandising system having one or more of these or other advantageous features.

SUMMARY

The present invention relates to merchandising system including a first divider, a second divider, and a third divider. The merchandising system further includes a first connector and a second connector. The first connector couples the first divider and the second divider. The first connector provides for selective size adjustability between the first divider and the second divider. The second connector couples the second divider and the third divider. The second connector provides for selective size adjustability between the second divider and the third divider.

The present invention also relates to a modular divider system including at least three dividers configured to be spaced apart relative to each other and at least two interfaces. An individual interface is provided between two adjacent dividers and the individual interface provides for selective adjustability between two adjacent dividers.

The present invention further relates to a merchandising system for providing compartments for merchandise or the like including a plurality of divider members. Individual divider members are spaced relative apart relative to each other. The merchandising system further includes a plurality of connectors. An individual connector is provided between two adjacent divider members, and the individual connector provides for selective adjustment of the spacing of the two adjacent divider members so that the size of the compartments is determined by the spacing of the adjacent divider members.

The present invention further relates to a merchandising system for a product including at least three divider panels being spaced apart relative to each other, a first connector configured to couple a first set of adjacent divider panels, and a second connector configured to couple a second set of adjacent divider panels. The first and second connectors further comprise a series of alternating teeth and grooves.

The present invention further relates to a divider system for providing selective size adjustment of compartments for merchandise or the like. The divider system includes a first panel, a first interface coupled to the first panel, a second panel coupled to the first interface, a second interface coupled to the second panel, and a third panel coupled to the second interface. The first and second panels may be selectively moved relative to each other, and the second and third panels may be selectively moved relative to each other.

The present invention further relates to a merchandising system having a number of dividers, where a pair of adjacent dividers forms a facing, and the merchandising system has at least two facings. The merchandising system includes at least one connector provided between each pair of dividers. The connector provides for the selective width adjustment of a facing without altering the width of an adjacent facing.

The present invention further relates to a method of repairing a divider system having sets of adjacent divider panels. The method includes providing a connector between each set of adjacent divider panels. The connector provides for the selective width adjustability of the set of adjacent divider panels.

The present invention further relates to a merchandising system comprising two divider panels and a connector provided between the two divider panels. The connector includes an index of grooves and teeth configured to selectively coact with the two divider panels.

The present invention further relates to a method for providing selective spacing adjustment for a merchandising system, the merchandising system having a number of panels. The method includes providing a number of connectors, where an individual connector is provided between two adjacent panels. The method further includes selectively engaging and disengaging the connector with one or more adjacent panels to provide for selective width adjustment of adjacent panels. Adjusting the width of a first set of dividers does not alter the width of a second set of adjacent dividers.

BRIEF DESCRIPTION OF THE DRAWINGS

FIG. 20A is a top plan view of a connector for use with the merchandising system shown in FIG. 12.

FIG. 20B is a perspective view of the connector shown in FIG. 20A.

FIG. 20C is a front elevation view of the connector shown in FIG. 20A.

FIG. 20D is a side elevation view of the connector shown in FIG. 20A.

FIG. 21A is a top plan view of a second connector for use with the merchandising system shown in FIG. 12.

FIG. 21B is a perspective view of the connector shown in FIG. 21A.

FIG. 21C is a front elevation view of the connector shown in FIG. 21A.

FIG. 21D is a side elevation view of the connector shown in FIG. 21A.

DETAILED DESCRIPTION OF THE EXEMPLARY EMBODIMENTS

Referring to the FIGURES, exemplary embodiments of a merchandising system are shown. The merchandising system may provide for display, space division, and orderly presentation of products. The merchandising system may provide for selective size (shown as width) adjustment of a product display, "facing," cell, compartment, or display area, while not requiring the width adjustment of adjacent product displays, "facings," cells, compartments, or display areas. As shown in FIG. 1A, a merchandising system 10 may provide a large number of facings. Should a single facing need to be adjusted (for example, to accommodate a differently sized product), that single facing may be readily adjusted without the need to resize any (or potentially all) of the remaining facings.

The merchandising system may further provide for modularity in the construction and assembly of the merchandising system. For example, product displays, "facings," cells, compartments, or display areas may be added and/or removed to an existing merchandising system by reconfiguring the number and arrangement of dividers and connectors.

The merchandising system may be a shelf system, shelf divider system, product facing tray system, product self-facing and organization tray system, divider system, shelf tray system, pusher system, dispensing system, tray system, etc. The merchandising system may be provided for use on a shelf (or any portion of a shelf), shelves, racks, displays, or other merchandising systems, or alternatively may be provided as a separate, independent merchandising system. According to other alternative embodiments, the system may be configured or oriented to provided for vertical size (e.g. height) adjustment.

Figure 1:
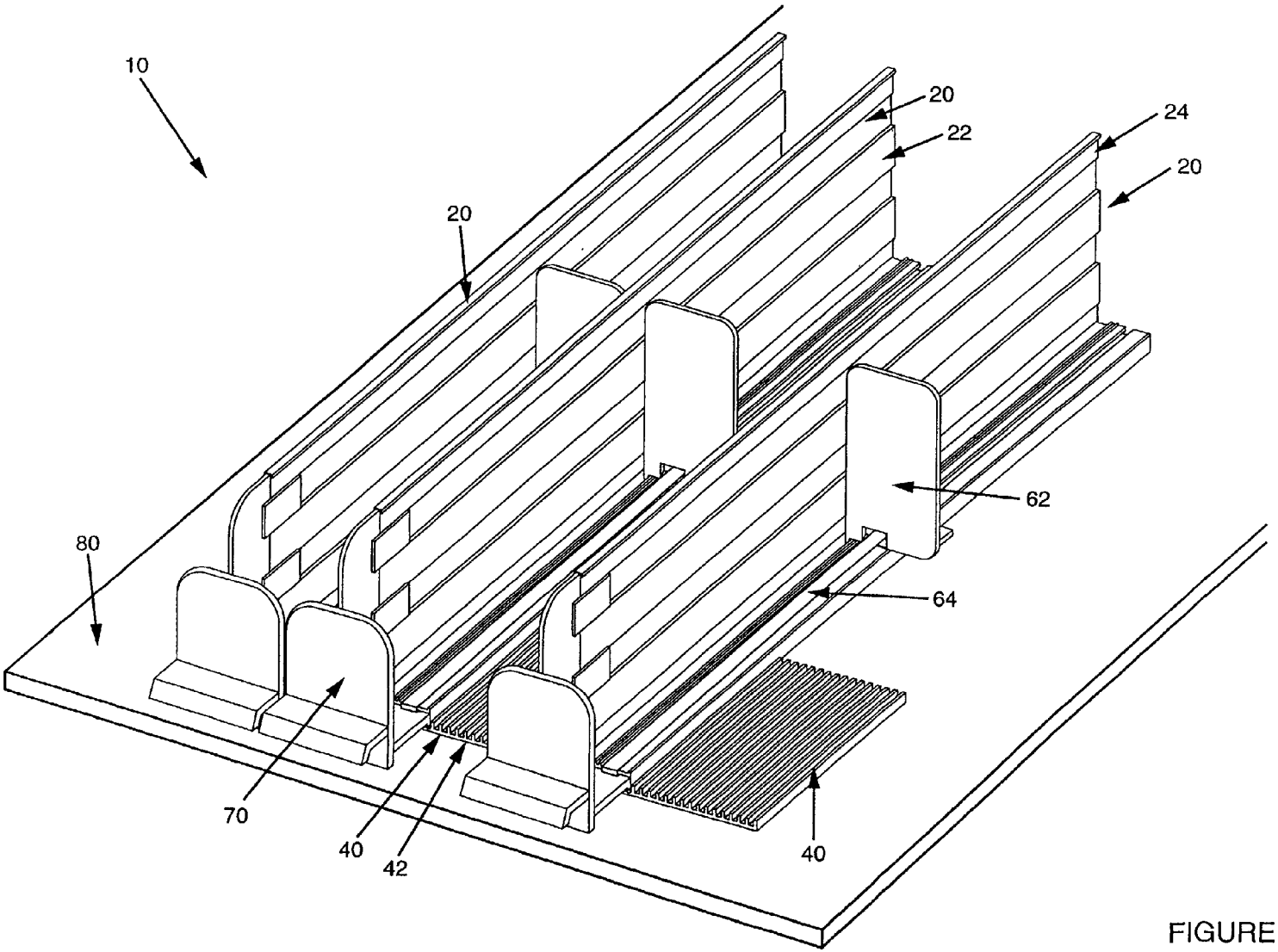
FIG. 1 is a perspective view of a merchandising system according to one exemplary embodiment.
Figure 1A:
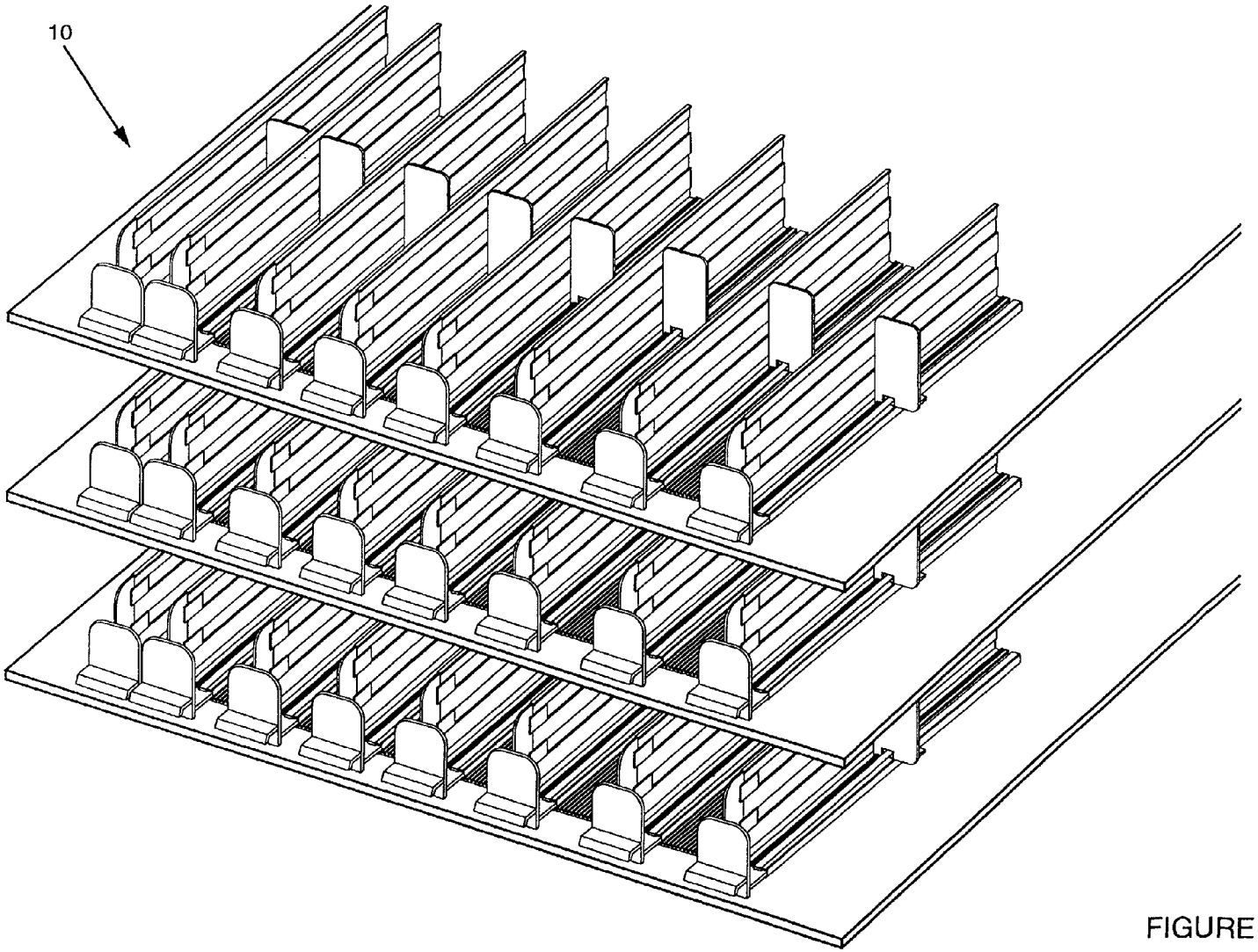
FIG. 1A is a perspective view of a merchandising system according to one exemplary embodiment.

Shown in FIG. 1 is one exemplary embodiment of a merchandising system 10. As shown, merchandising system 10 has a modular configuration that includes one or more dividers 20 (which may be panels, dividers, separators, divisions, partitions, tracks, extrusions, panels, channels, or other panels or members, etc.) and one or more connectors 40 (which may be interfaces, couplings, connecting members, adjustment members, "combs," connector modules, etc.). Dividers 20 provide space division, separation, organization, and merchandise variously sized products (not shown). Adjacent dividers (shown as dividers 22 and 24) are coupled with an intermediate link or connector 42.

Figure 2:
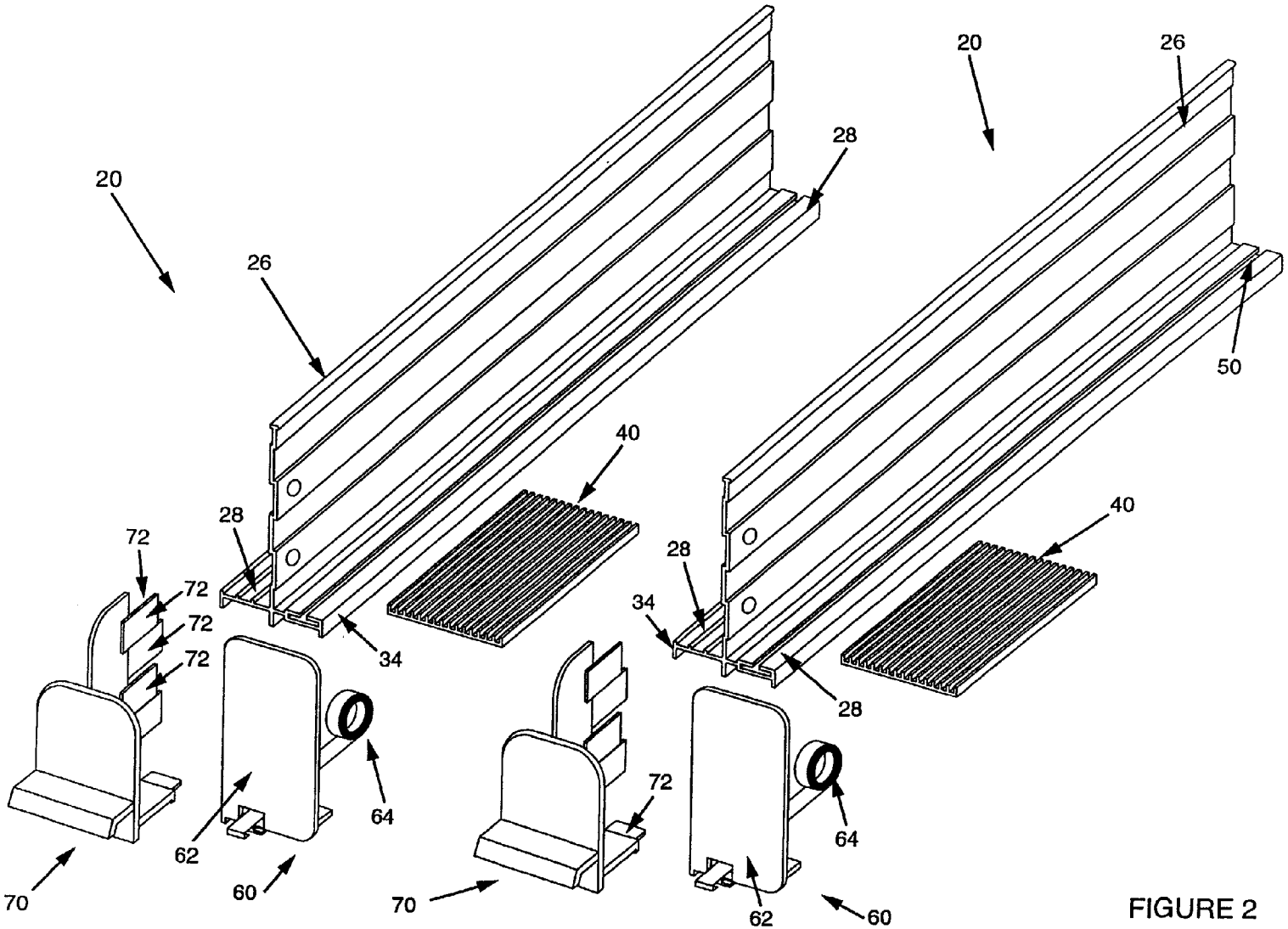
FIG. 2 is an exploded view of the merchandising system shown in FIG. 1.
Figure 8:
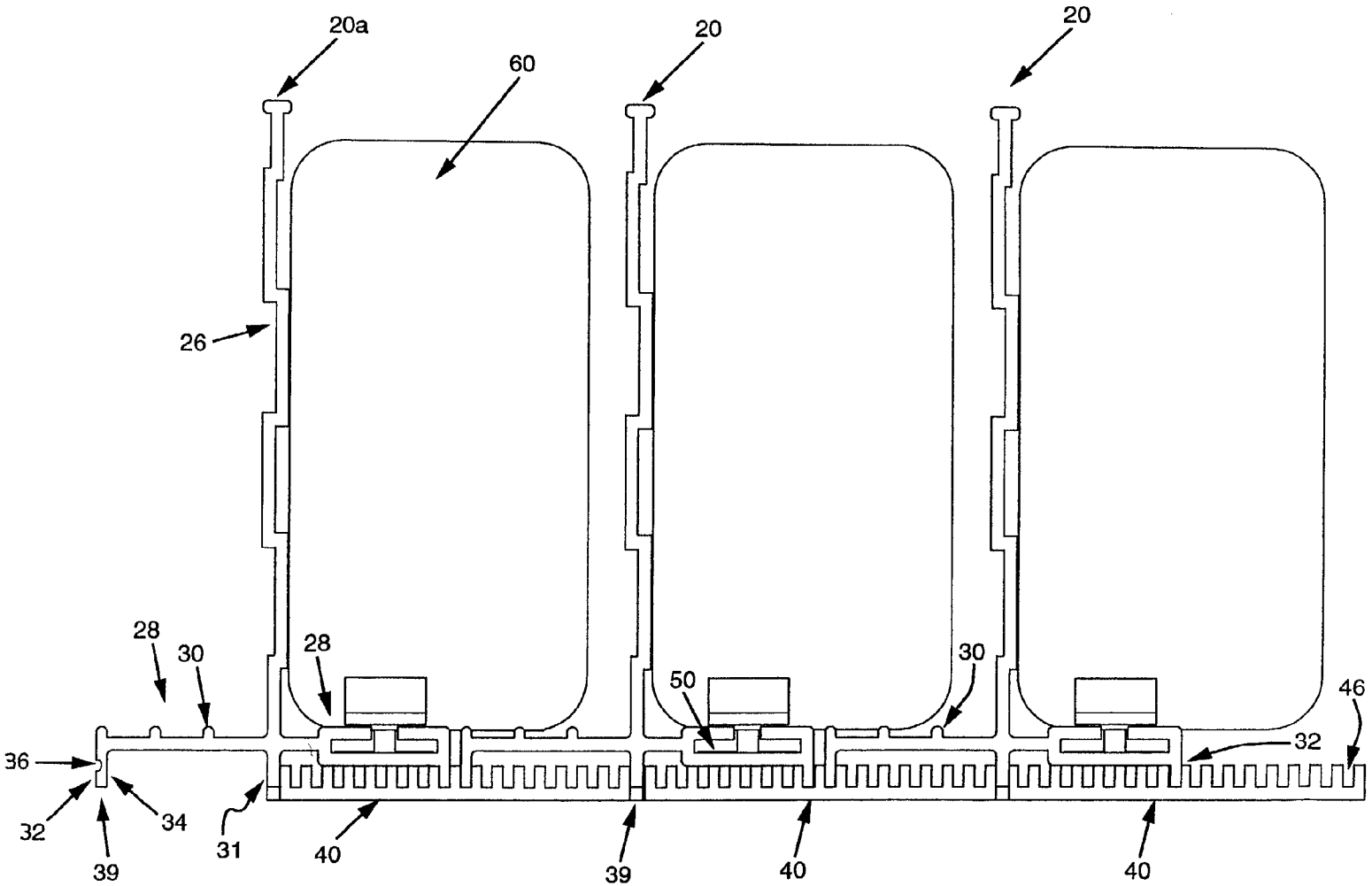
FIG. 8 is a front elevation view of the merchandising system shown in FIG. 7, with the front plates removed.
Figure 9:
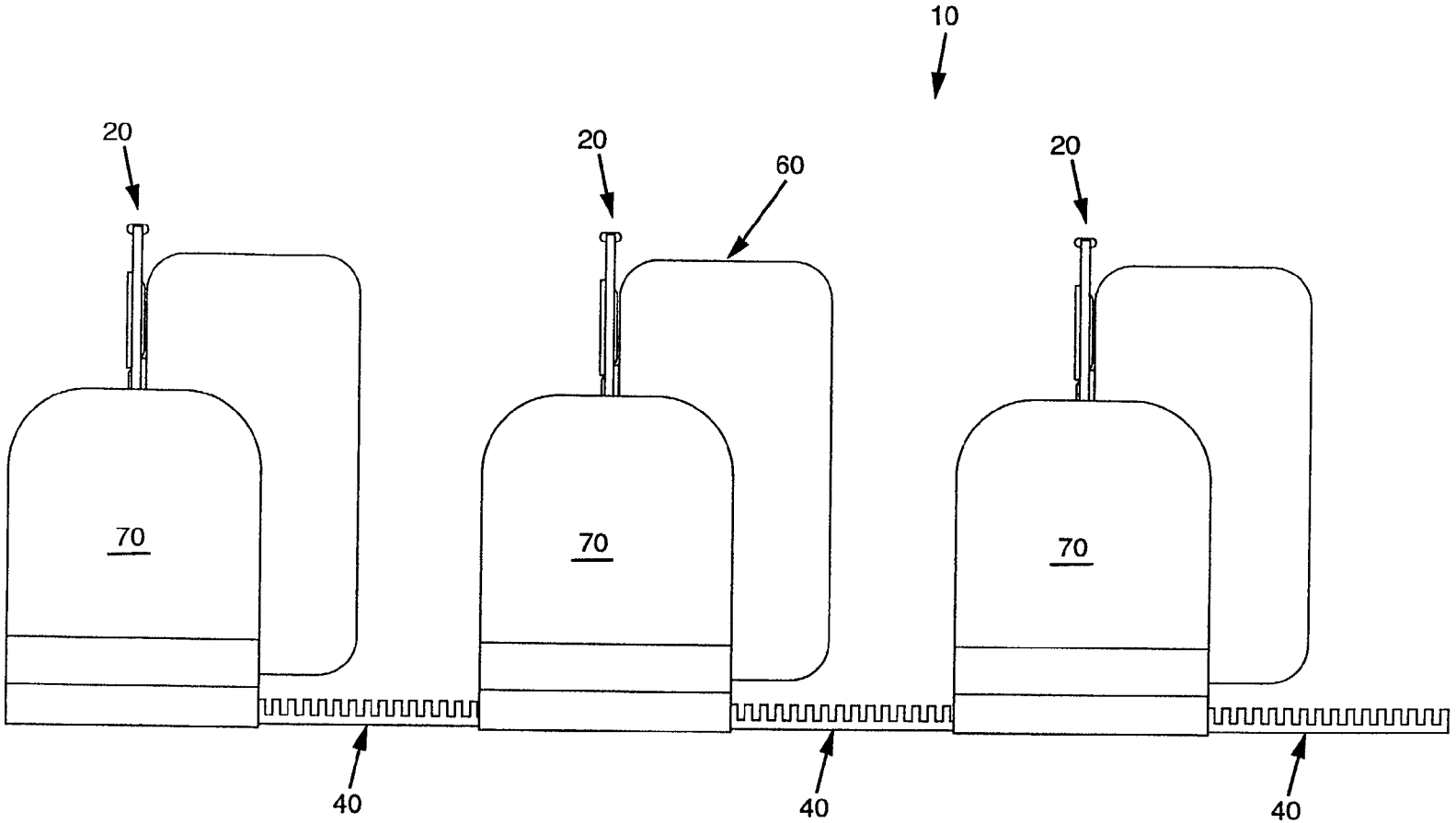
FIG. 9 is a front elevation view of the merchandising system shown in FIG. 1, showing a second adjustment position.

As shown in FIG. 2, divider 20 comprises a panel section (shown as portion 26), and one or more product support surfaces (shown as portions 28). As shown in FIG. 8, divider 20 (which may be tracks, extrusions, panels, channels, open frame or rail, etc.) may be provided in a variety of configurations, including a center divider 20*a* (shown in FIG. 10A), and an end divider 20*b* (shown in FIG. 10A). According to one particularly preferred embodiment, a merchandising system 10 includes any desired number of center dividers 20*a* and two end dividers 20*b*.

According to one particularly preferred embodiment, divider 20 may have a "T-shaped" cross section. As shown in FIG. 8, divider 20 may provide a product support surface, horizontal section, or portion (shown as portion 28), and a panel section, vertical section, division panel or portion (shown as portion 26). Portions 26 and 28 form a "T" shaped cross-section. (See FIG. 8). Portion 28 may be provided with friction reducing ribs or protrusions (shown as ribs 30). Ribs 30 provide friction reduction on a product support surface (e.g. portion 28) such that product which is being displayed or supported on merchandising system 10 may move more easily along the length of divider 20. Additionally, portion 28 may be provided with rib 31 on an opposite side of ribs 30. Rib 31 may increase the stiffness, strength, or rigidity of divider. Alternatively, rib 31 may be configured to help support divider 20 on a surface such as a shelf, merchandising system, etc.

Figure 38:
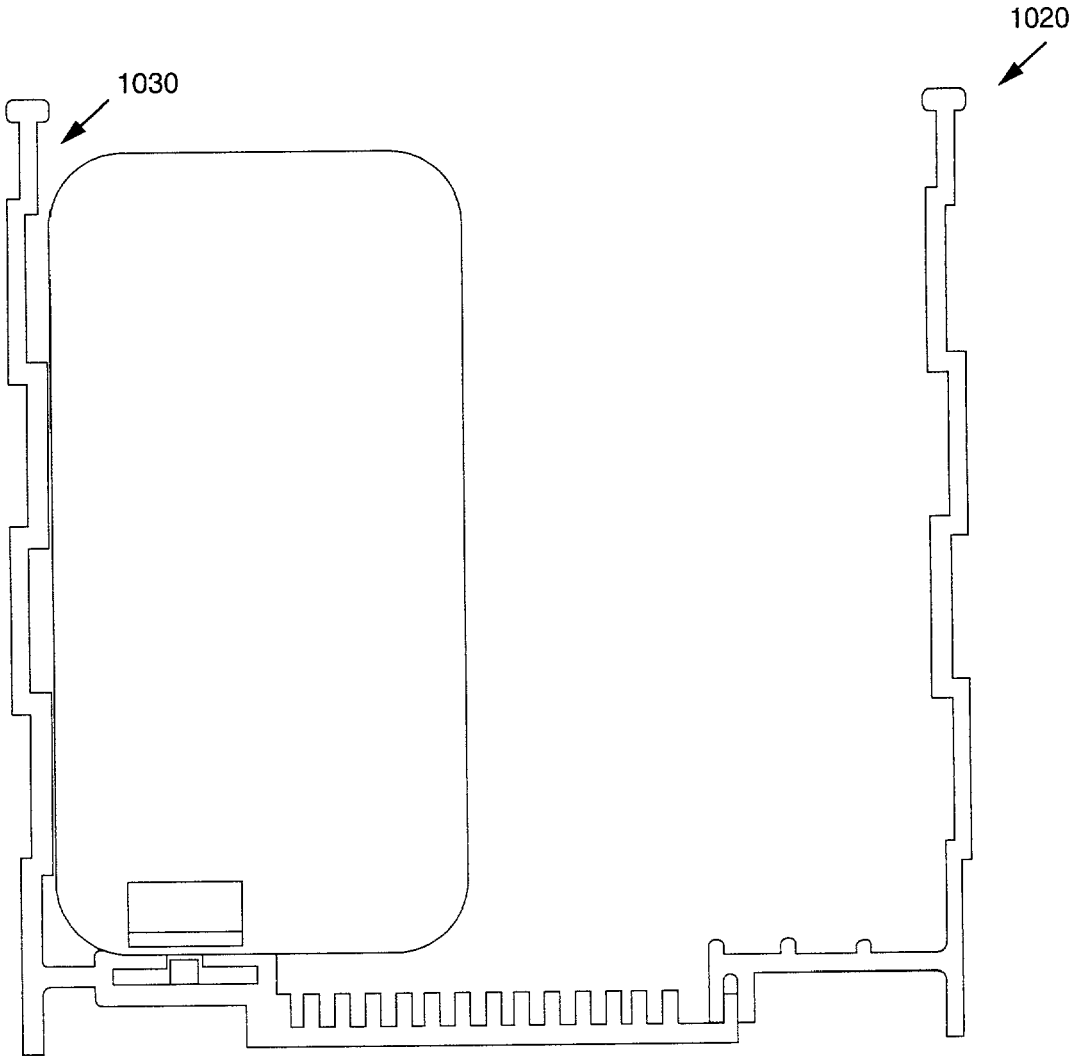
FIG. 38 is front elevation view of a panel member and a connector according to alternative embodiments.

Divider 20 further includes one or more engagement portions 32 configured to engage, couple, connect, coact or otherwise interface with connector 40. As shown in FIG. 8, engagement portion 32 comprises a projection or leg 34 provided on bottom side of divider 20. Leg 34 is configured to engage with connector 40. According to a particularly preferred embodiment, leg 34 engages connector 40 via a friction-fit or interference-fit. According to another particularly preferred embodiment shown in FIG. 8, leg 34 may be provided with a groove or depression (shown as depression 36) which is configured to interface with a projection 42 on a tooth 44 of connector 40 (see FIGS. 6A and 6B). According to an alternative embodiment shown in FIG. 38, a tooth (or leg) on a connector may be configured to engage in a groove provided on the divider.

Figure 4:
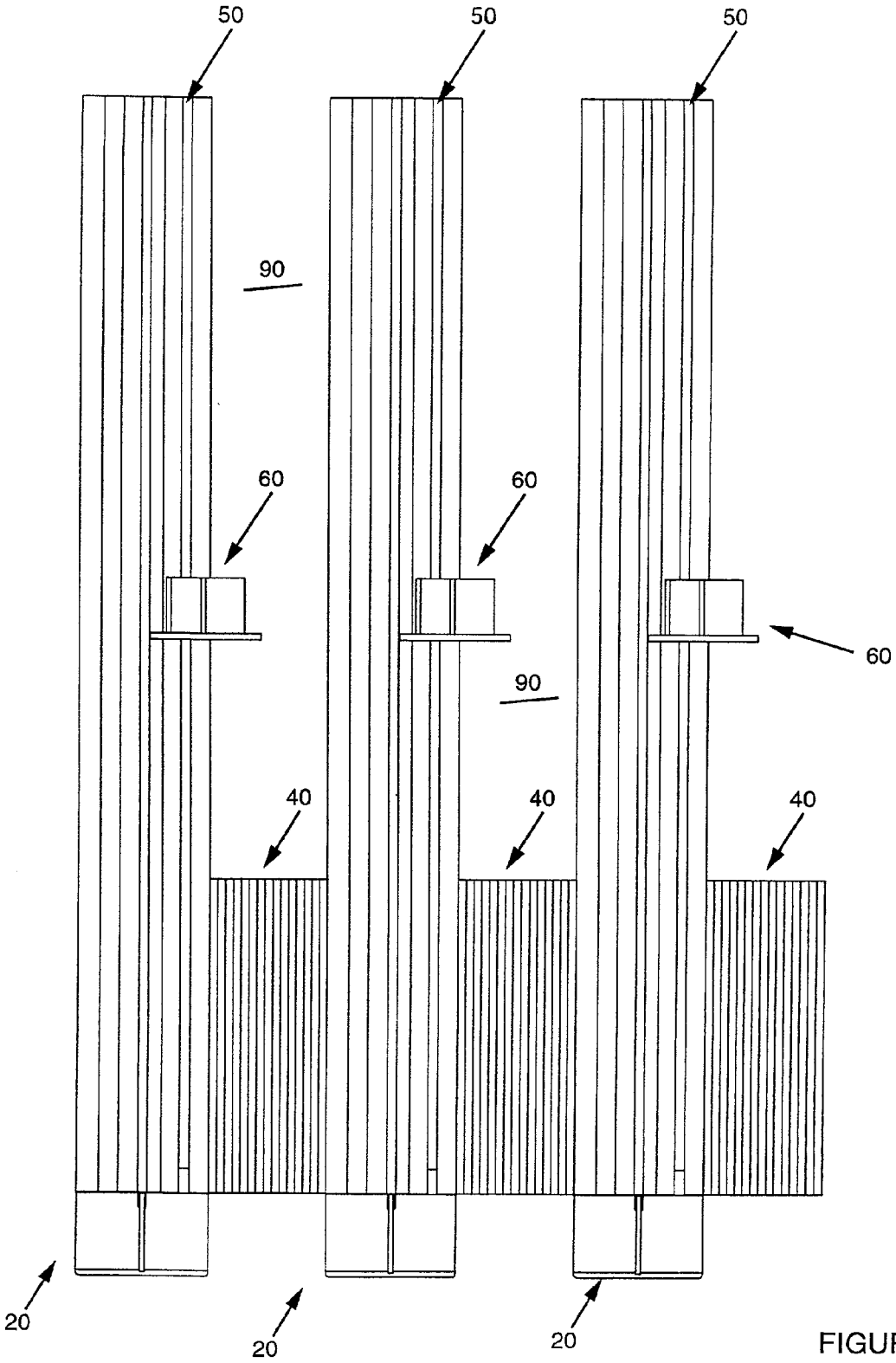
FIG. 4 is a top plan view of the merchandising system shown in FIG. 1, showing a first adjustment position.
Figure 5:
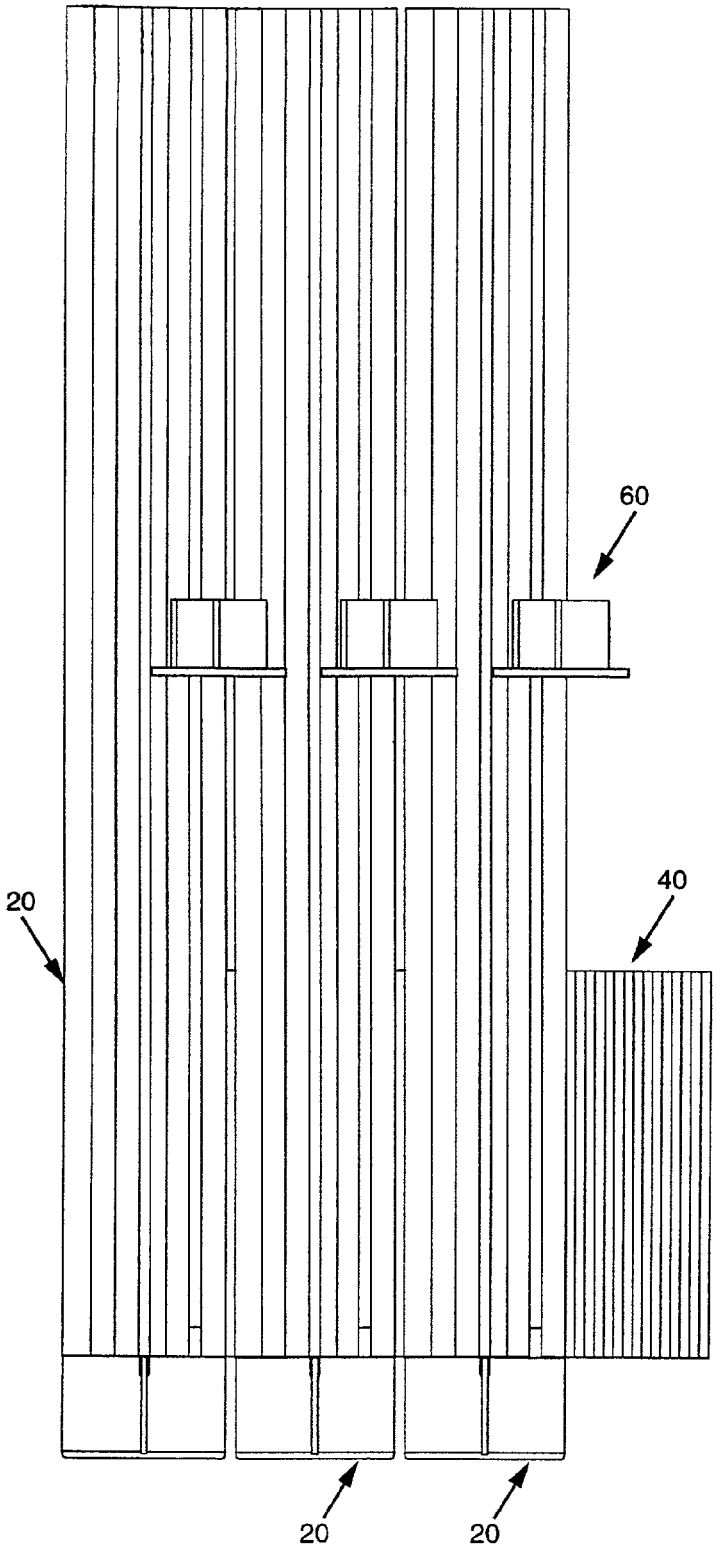
FIG. 5 is a top plan view of the merchandising system shown in FIG. 4, showing a second adjustment position.

As shown in FIGS. 2 and 4, divider 20 may be further provided with a slot 50 (which may be a slot, channel, track, guide, pusher track, etc.) for receiving a pusher assembly 60 or other product biasing mechanism. It should be noted that the various embodiments of the merchandising system shown may be used with any type of panel or divider sections (or partitions), including merchandising systems that does not employ pushers or product biasing mechanisms. According to various other exemplary embodiments, the slot may be omitted.

Figure 10:
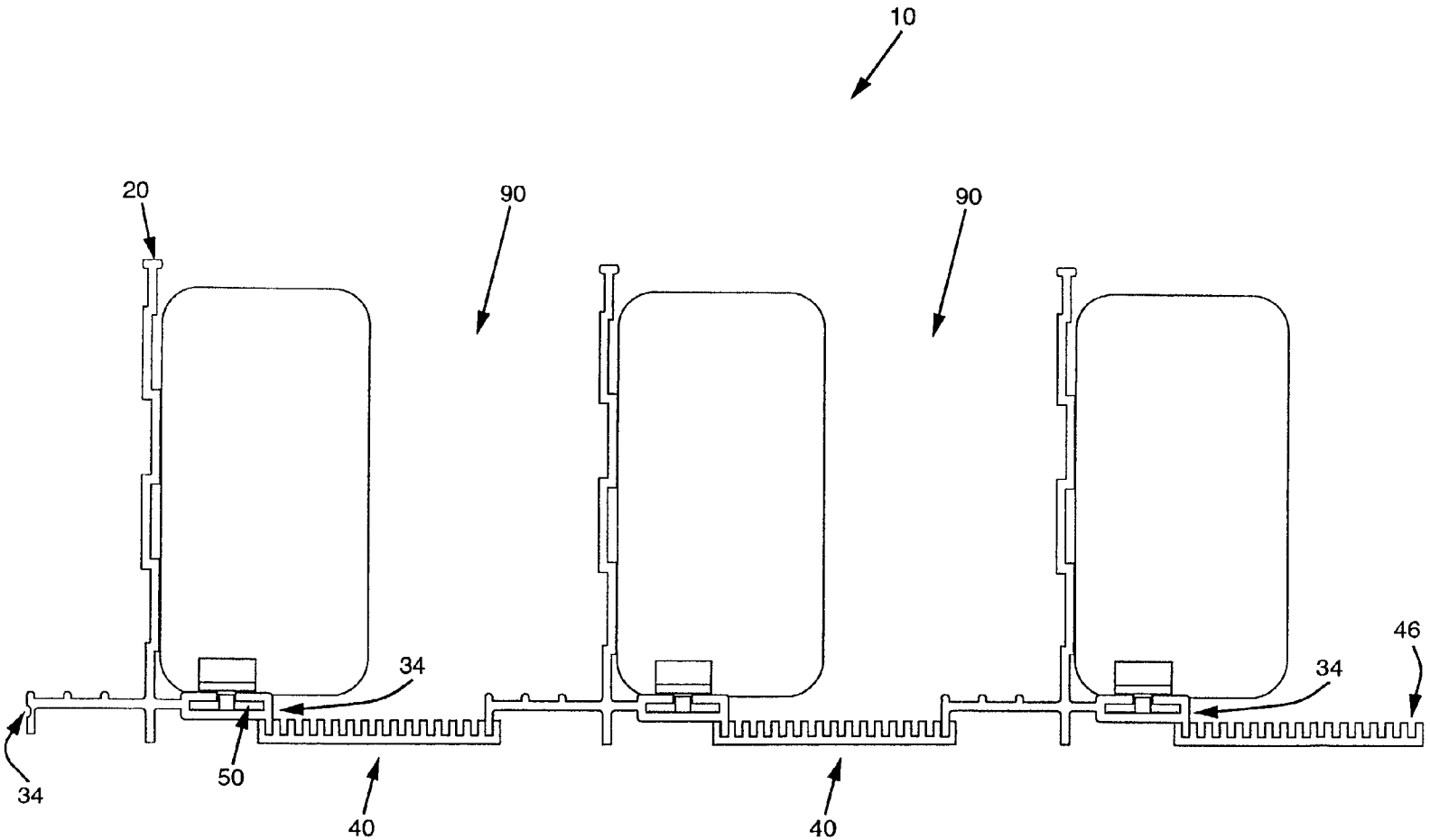
FIG. 10 is a front elevation view of the merchandising system shown in FIG. 9, with the front plates removed.
Figure 10A:
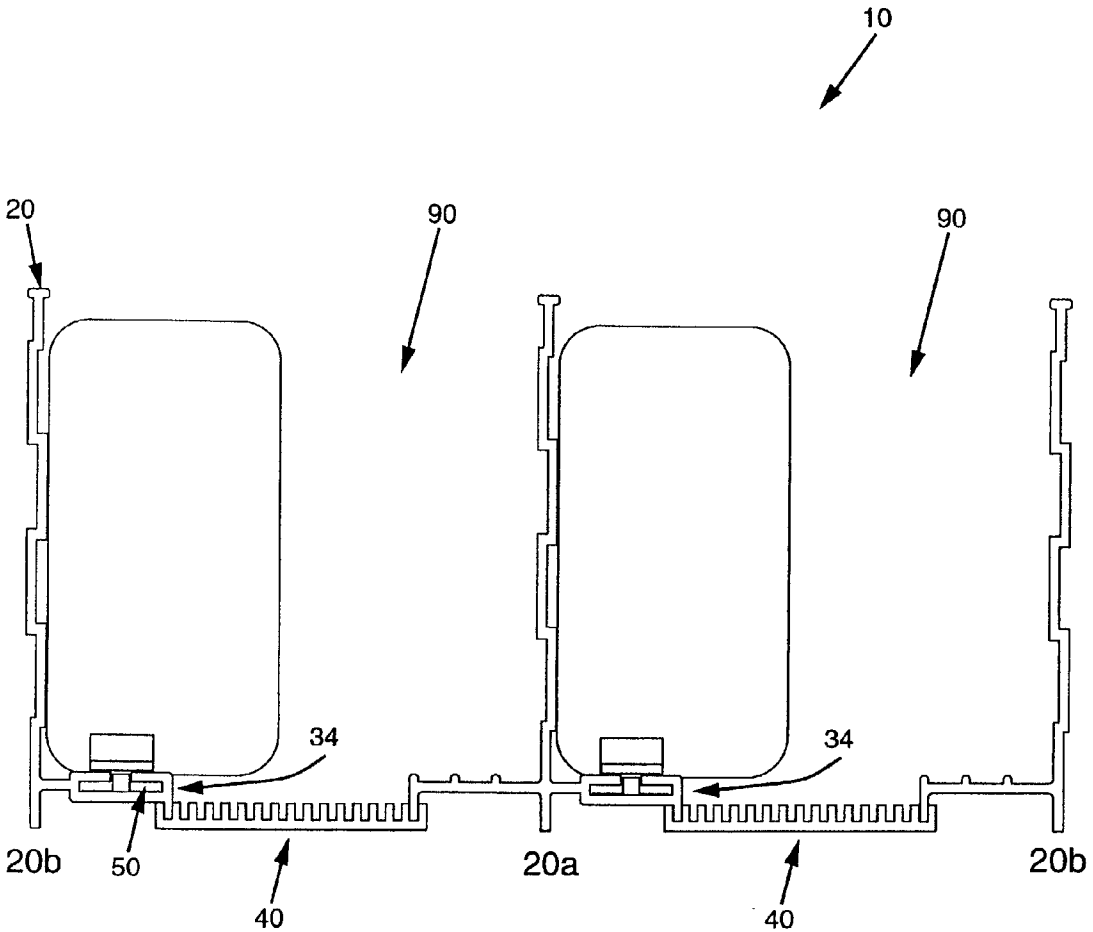

According to a particularly preferred embodiment shown in FIG. 10A merchandising system 10 further includes two end dividers 20*b*. End divider 20*b* may have an "L-shaped" cross section. Alternatively, other shaped dividers may be used, including dividers have a cross section similar to center dividers 20*a*.

As shown in FIG. 10A, end divider 20*b* may have a left-hand and right-hand orientation. The left-hand orientation has a similar cross-section to divider 20*a* shown in FIG. 10A, but omits a portion 28*a* having ribs 32 (see FIG. 10). The right-hand orientation has a similar cross-section to divider 20*a* shown in FIG. 10A, but omits a portion 28*b* having slot 50.

According to one particularly preferred embodiment, the dividers are constructed from extruded plastic. According to one alternative embodiment, the dividers may be constructed from injection molded plastic. A variety of plastics may be used in constructing or assembling the dividers. For example, the dividers may be constructed or assembled from high-impact plastics, polymers, high-impact plastic. Using plastic offers several advantages including that the pieces may be constructed in a variety of different colors, surface finished, textures, etc. According to various alternative embodiments, a variety of other known or suitable materials may be used including metals, alloys, composites, etc.

Figure 6A:
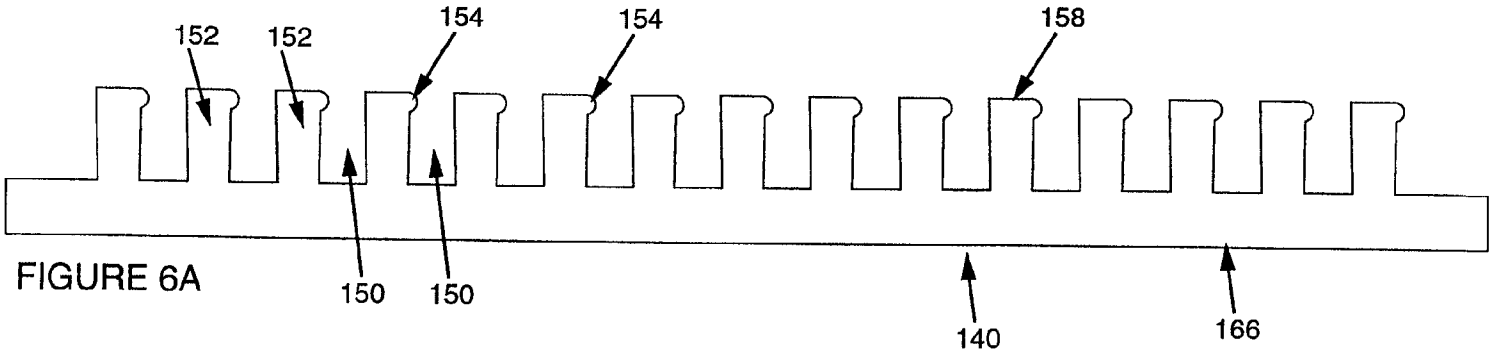
FIG. 6A is a front elevation view of a connector for use with a merchandising system according to one exemplary embodiment.

As shown in FIG. 1, connector 40 of merchandising system 10 may be a flat elongated member (which may be a web, mat, etc.). As shown in FIG. 6C, connector 40 may be provided with a series of grooves 46 (which may be notches, grooves, cuts, etc.) thereby forming a series of teeth 52 (which may be projections, extensions, etc.). According to various alternative embodiments, a connector may be provided with a series or index of grooves along a portion (either width or length) of the connector (i.e. provided along a partial width or partial length of the connector). According to a particularly preferred embodiment (shown in FIG. 1), grooves 46 extend along the length of connector 40.

Grooves 46 may be provided with any desired spacing or placement between adjacent grooves. According to one exemplary embodiment, grooves 46 are provided every 0.125 inch along the width of connector 40. According to various alternative embodiments, grooves may be provided at any desired spacing, with any desired number of grooves.

Connector 40 is configured to coact (e.g. receive, couple, engage or otherwise connect) with divider 20. As shown in FIGS. 8 and 10, the width of groove 46 is approximately equal to the width of leg 34 on divider 20. As shown in FIG. 6A, projections shown as teeth 152 may be provided with an enlarged area (shown as extension 154). According to one particularly preferred embodiment shown in FIG. 6B, extension 254 may be provided on both sides of teeth 252. Extension 254 projects into the space formed between the adjacent teeth (i.e. grooves 250). Extension 254 is intended to provide for a more secure engagement between the connector 40 and divider 20, by "snapping" or projecting into recess or depression 36. According to one alternative embodiment (as shown in FIG. 6A), extension 154 may be provided on only one side of teeth 152. According to another alternative embodiment, as shown in FIG. 6A, connector 240 may be provided with a series of straight grooves and teeth. According to other various alternative embodiments, a variety of shapes, sizes, spacings, arrangements, and other configurations may be provided with the connector.

Connector 40 may be provided in one or a variety of unit sizes (e.g. length or width) or shapes (e.g. orthogonal or diagonal or curved). According to a particularly preferred embodiment, connector 40 has a length of 4.0 inches. According to another particularly preferred embodiment, connector 40 has a length of 6.0 inches. According to another particularly preferred exemplary embodiment, connector 40 has a length of 8.0 inches. Alternatively, the connector may be provided in (or may be "field-cut" to) a variety of lengths or sizes which allow for the connectivity and/or interface with dividers.

According to one particularly preferred embodiment, the connectors are constructed from extruded plastic. According to one alternative embodiment, the connectors may be constructed from injection molded plastic. A variety of plastics may be used in constructing or assembling the connectors. For example, the connectors may be constructed or assembled from high-impact plastics, polymers, high-impact plastic. Using plastic offers several advantages including that the pieces may be constructed in a variety of different colors, surface finished, textures, etc. According to various alternative embodiments, a variety of other known or suitable materials may be used including metals, alloys, composites, etc.

Figure 3:
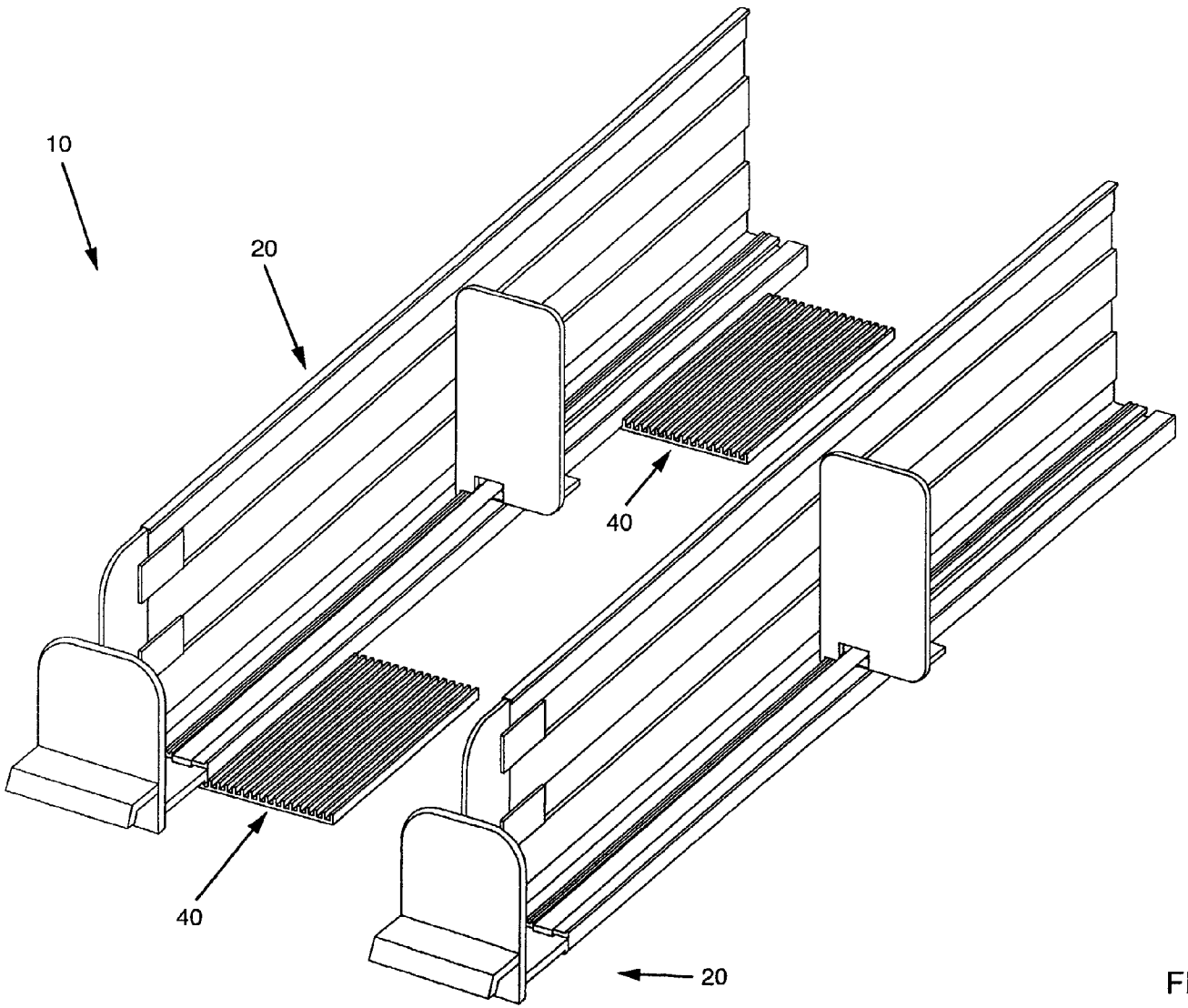
FIG. 3 is a perspective view of a merchandising system according to an alternative embodiment.

As shown in FIG. 3, one or more connectors 40 may be provided between adjacent dividers 20. Providing one connector between adjacent dividers (see FIG. 1) allows connector 40 to be easily accessed from the front, thereby allowing for adjustment to be accomplished relatively easily. Providing two connectors 40 between adjacent dividers 20 (see FIG. 3) provides for added stability between adjacent dividers.

As shown in FIG. 2, merchandising system 10 may further comprises a slot 50 and pusher assembly 60. Pusher assembly 60 may comprise a pusher 62 and a biasing element 64.

Figure 12:
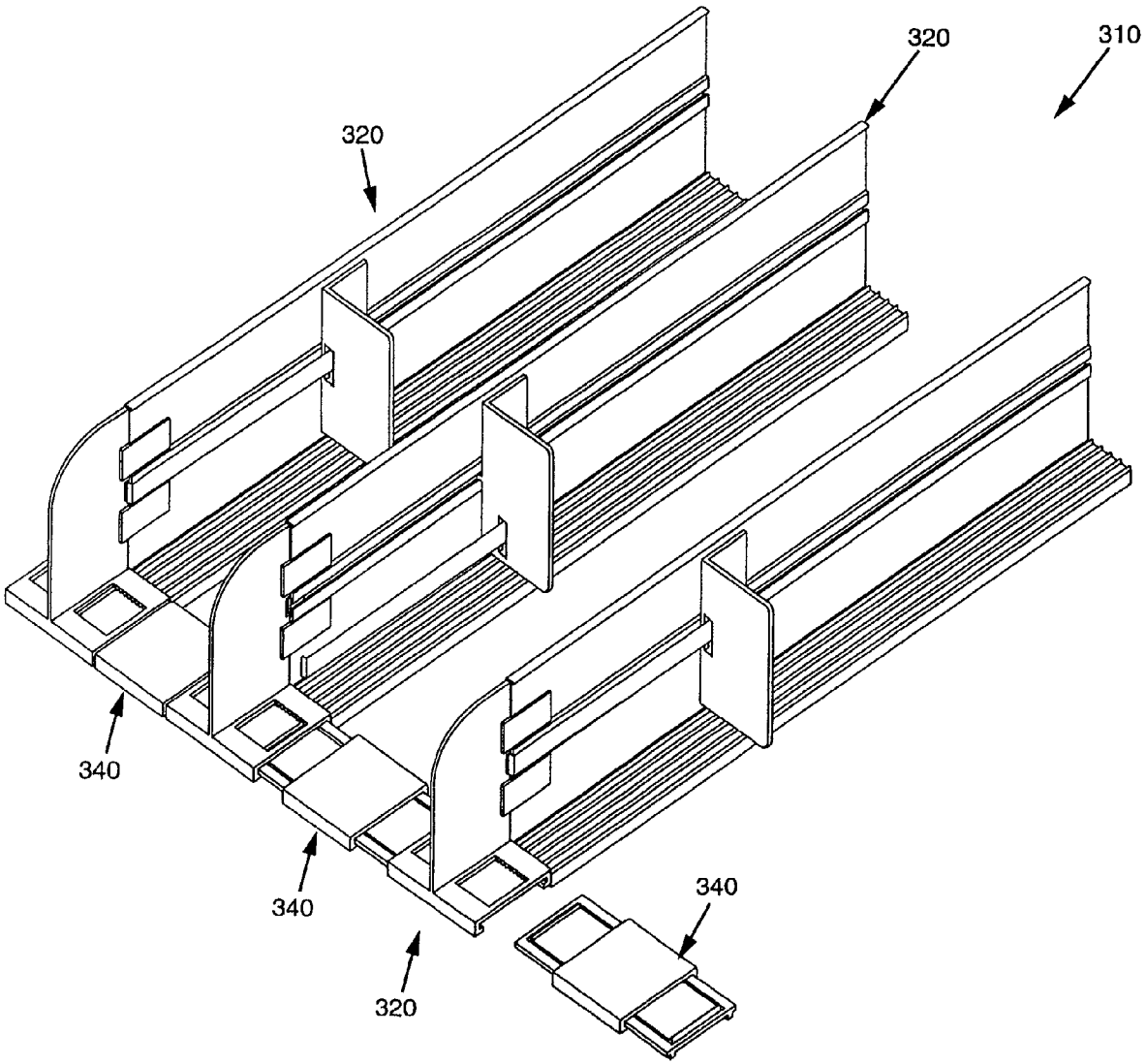
FIG. 12 is a perspective view of a merchandising system according to a second exemplary embodiment.
Figure 13:
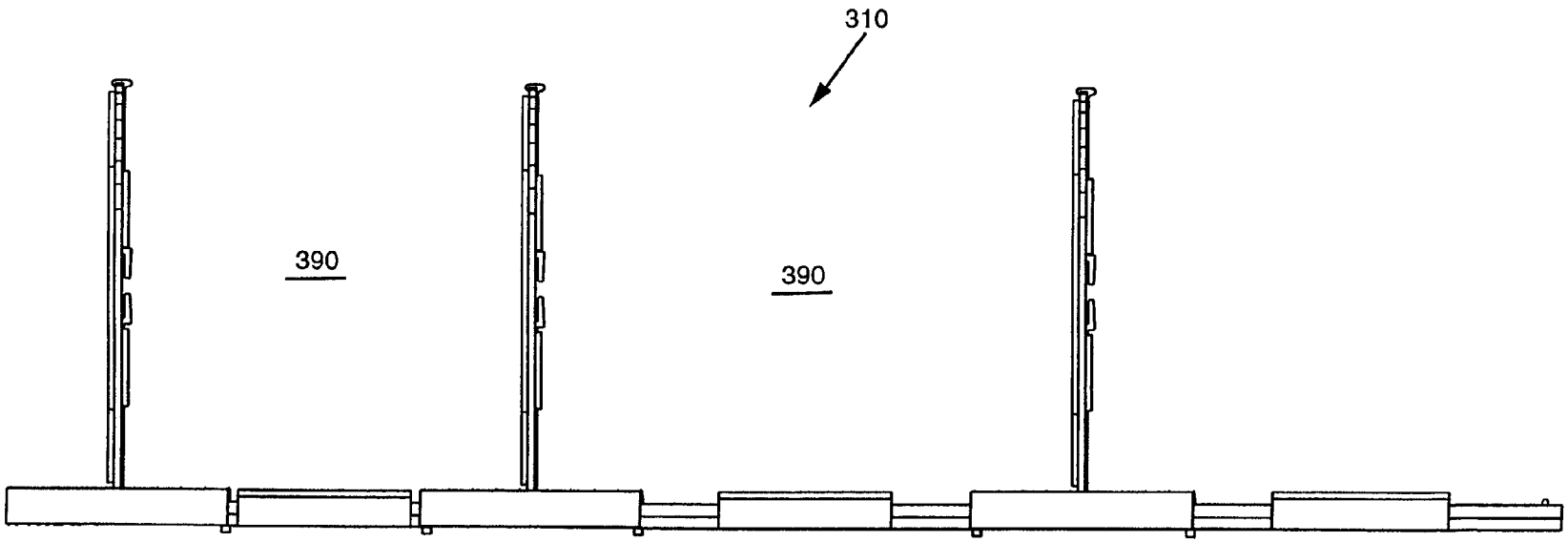
FIG. 13 is a front elevation view of the merchandising system shown in FIG. 12.
Figure 14:
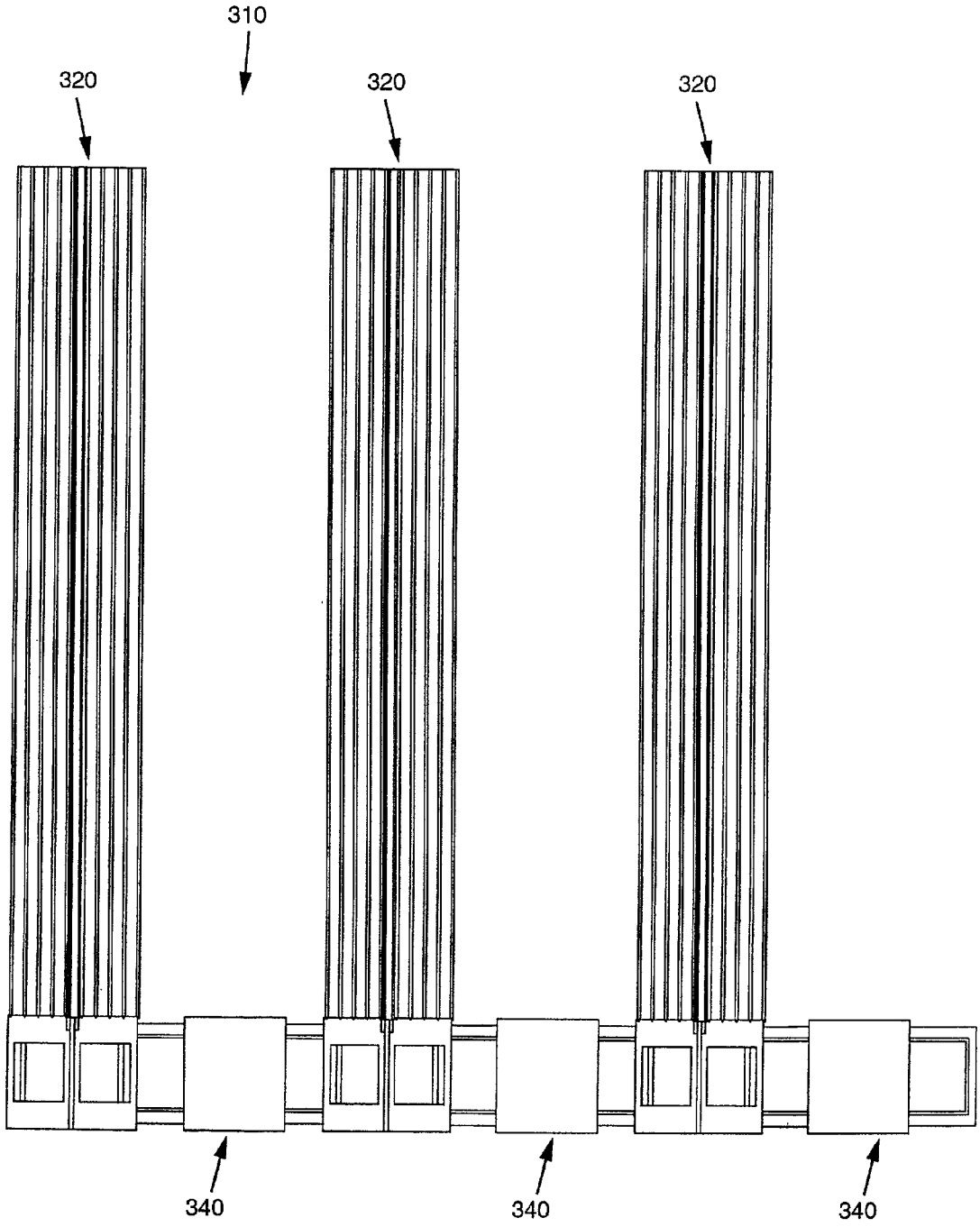
FIG. 14 is a top elevation view of the merchandising system shown in FIG. 12, showing a first adjustment position.

Slot 50 may be provided in a variety of locations, including in one of the product support surfaces 28 (see FIG. 2), or alternatively may be provided in the panel section (see FIG. 12). According to one exemplary embodiment (shown in FIG. 1), slot 50 is provided along a length of divider 20. Slot 50 may be "pinched off" or otherwise reduced down in size toward the back of divider 20 during an extrusion process in order to prevent pusher 62 from being pushed too far back, thereby being pushed out of slot 50.

Pusher assembly 60 may comprise a pusher face 62 and a biasing element shown as coil spring 64 (according to one exemplary embodiment). Pusher assembly 60 is configured to automatically advance or urge forward product which is to be displayed or otherwise merchandised. Pusher 62 is configured to slide or move along slot 50. Biasing element 64 urges pusher 62 towards the front of merchandising system 10, thereby urging forward the displayed product.

Figure 11A:
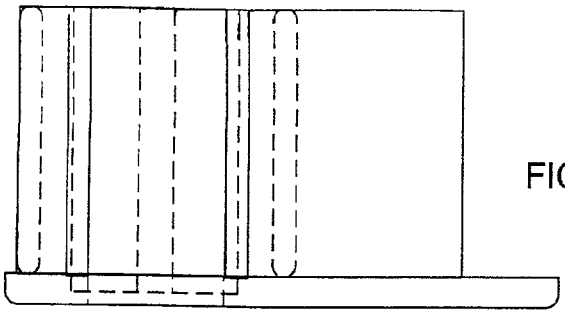
FIG. 11A is a top plan view of a pusher for use with a merchandising system according to one exemplary embodiment.
Figure 11B:
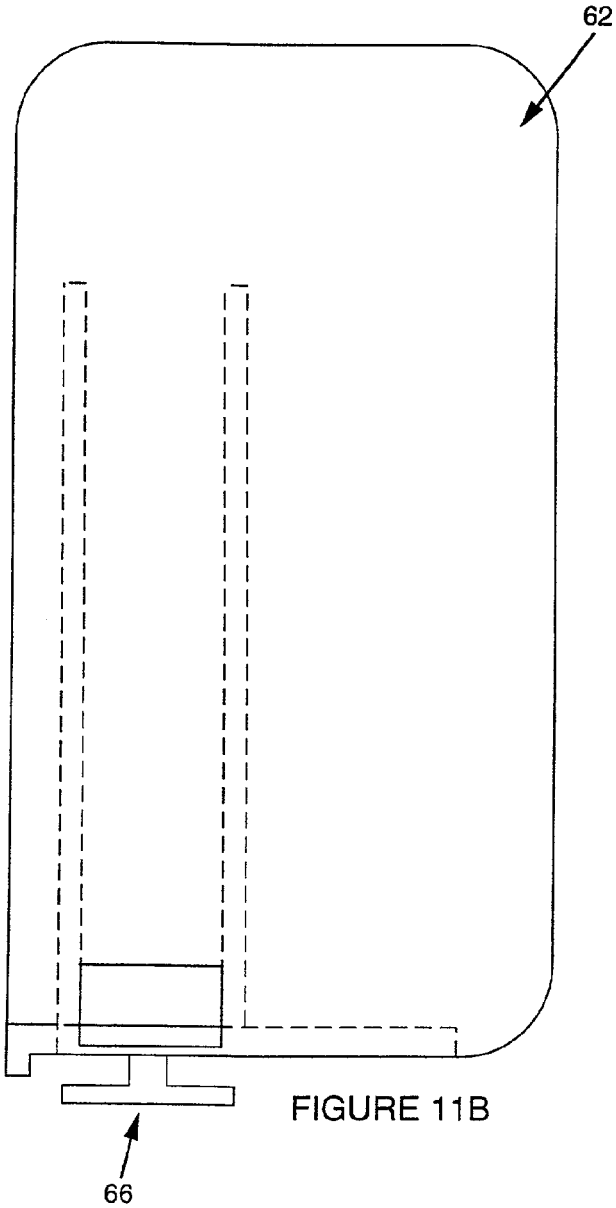
FIG. 11B is a front elevation view of a pusher shown in FIG. 11A.
Figure 11C:
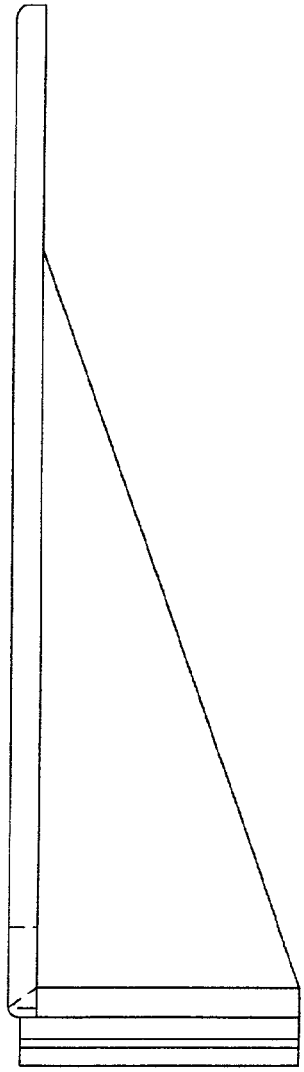
FIG. 11C is a side elevation view of a pusher shown in FIG. 11A.

As shown in FIGS. 11A through 11C, pusher 62 (which may be a pusher paddle, pusher face, etc.) may include a flat face, surface, or surfaces for pressing, pushing, moving, or urging product. Pusher 62 may further include a flange 66 (which may be a a T-shaped member, guide(s), track(s), rail(s), etc.) configured to fit in slot 50 and slide along slot 50. Pusher 62 may be provided with indicia (e.g. on the face) and may be provided in a variety of sizes and shapes to suit the application (e.g. product size).

As indicated in FIGS. 1 and 2, biasing element 64 (spring/coil spring biasing element/biasing mechanism or the like) may be provided to bias or urge pusher 62 toward the front of merchandising system 10. Biasing element 64 (shown as a coil spring), connects to the front of divider by a fastener (which may be hooks, hooking the spring to the front of divider, screws, rivets, connectors, bolts, crimping, etc.). The coiled portion of biasing element 64 is provided on a back side of pusher 62 so that when pusher 62 is retracted (i.e. pulled toward the back of merchandising system 10) biasing element 64 will bias pusher 62 in a forward direction.

Pusher 62 may generally be constructed from injection molded plastic. Other suitable materials (including metal) may be used according to alternative embodiments.

According to one particularly preferred embodiment, merchandising system 10 further comprises a plate 70. As shown in FIG. 1, plate 70 (which may be a wall, plate, lens, retainer, front plate, etc.) may be provided for use with merchandising system 10 to retain product against the force of pusher assembly 60. Plate 70 is configured to remain in place relative to divider 20, allowing plate 70 to retain product against the biasing force of pusher assembly 60. As shown in FIG. 2, plate 70 may be provided with clips, "fingers" or tabs 72 which fit on opposite sides of portion 26 of divider 20 to couple or hold plate 70 in place. Alternatively, the plate may be configured to interface with the divider at a variety of locations. In a preferred embodiment (shown in FIG. 1), plate 70 is constructed from a transparent (clear) material. Alternatively, the plate may be constructed from a variety of materials having different colors and opacity.

According to a particularly preferred embodiment, plate 70 may have an extension or leg extending from a front surface of plate 70. (See FIG. 1). The extension may be configured to engage with an existing track, rail, guide, etc on a shelf. Alternatively, the leg may be placed adjacent to the existing track and/or use the existing track as an alignment guide. Alternatively, the leg may be omitted as shown in FIG. 4.

As shown in the FIGURES, merchandising system 10 is intended to provide dividers 20 that may be selectively adjusted. Products or merchandise (not shown) may be placed between adjacent dividers 20. Pusher 62 will be in a position back from the front of a surface (shown as shelf 80) when fully stocked with products. As products are removed from merchandising system 10, pusher assembly 60 will push the remaining product forward to the front of shelf. It should be noted, however, that pusher assembly 60 is not required for use in various exemplary embodiments, which may be used in conjunction with other shelving divider arrangements (such as basic wall dividers).

Figure 7:
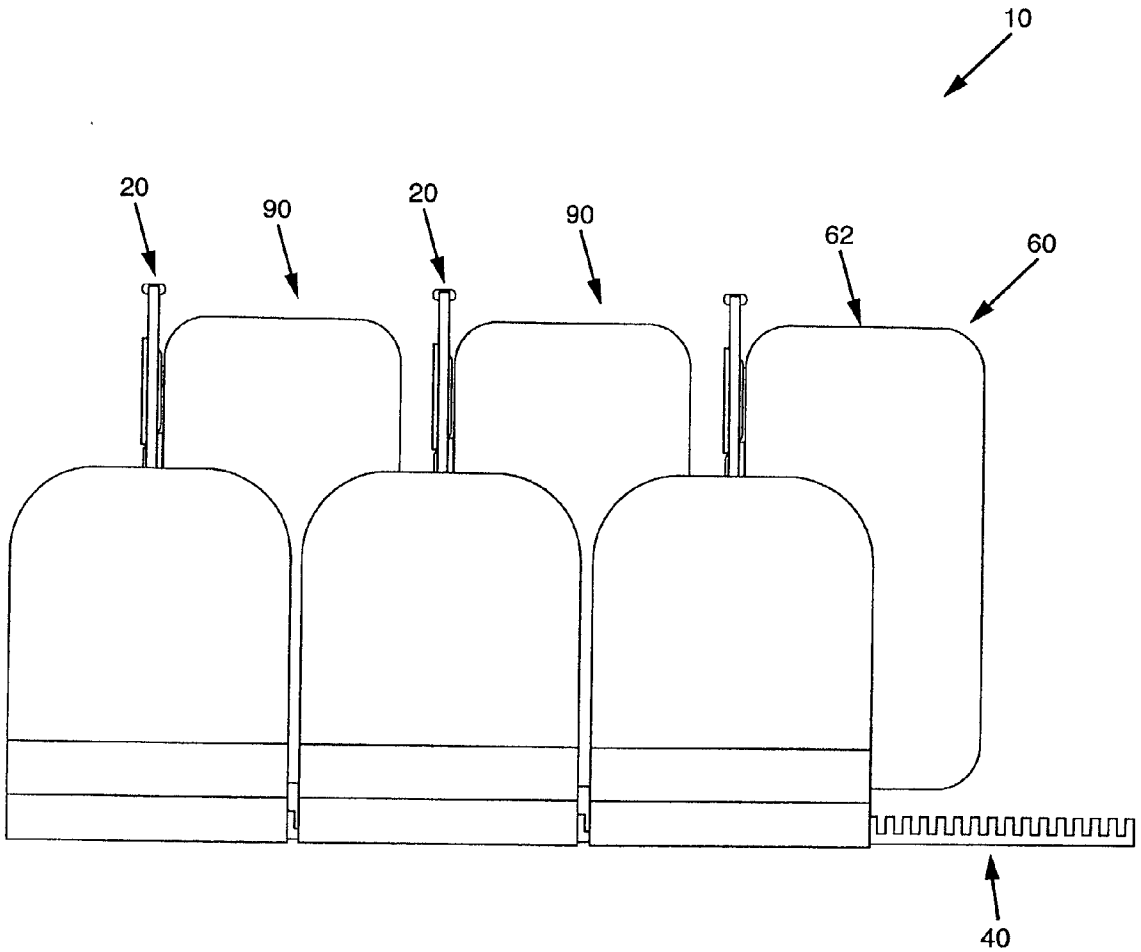
FIG. 7 is a front elevation view of the merchandising system shown in FIG. 1, showing a first adjustment position.

Merchandising system 10 shown in the FIGURES may allow dividers 20 to be reconfigured and resized for different sized divisions without the need to reconfigure or resize adjacent dividers. A "facing" or cell (shown as area 90 in FIGS. 4, 7, and 10) may be resized or have its width changed without needing to resize adjacent areas. This is an advantageous feature for a situation where one facing or cell needs to be resized for a different product size, but adjacent facings do not need to be so resized.

Merchandising system 10 may be placed on top of shelves or shelving units. Merchandising system 10 may simply rest on the top of a surface (shown as shelf 80 in FIG. 1), or may be supported by feet on shelf 80. According to a particularly preferred embodiment the feet may be a type of rubber or rubber padding. Alternatively, low-bond adhesives, soft-tack adhesives, plastics, polymers, elastomers, rubber (including craton rubber), other friction enhancing materials, etc. may be applied to restrict the motion of merchandising system 10.

According to one exemplary embodiment shown in FIGS. 1 through 11, divider 20 is constructed by co-extruding a material of a first rigidity (or flexibility) with a material of a second rigidity (or flexibility). According to a particularly preferred embodiment, divider 20 is a dual durometer extrusion having portions 26 and 28 constructed from a rigid PVC, and lower portion of leg 34 (shown as portion 39) constructed from a flexible, low tack, or "gummy" PVC. Portion 39 being constructed from a friction material (such as a "gummy" material) assists merchandising system to stay in place during use by increasing the friction between the divider and the support surface such as shelf 80. Additionally, portion 39 helps to increase the engagement between connector 40 and divider 20, thereby helping to prevent motion of divider 20 in a direction along the length of divider 20. According to various exemplary embodiments, non-skid material, other friction material, non-skid feet (e.g. of rubber or another elastomeric material or the like) may be provided on the bottom of the merchandising system (including dividers and connectors).

Figure 6B:
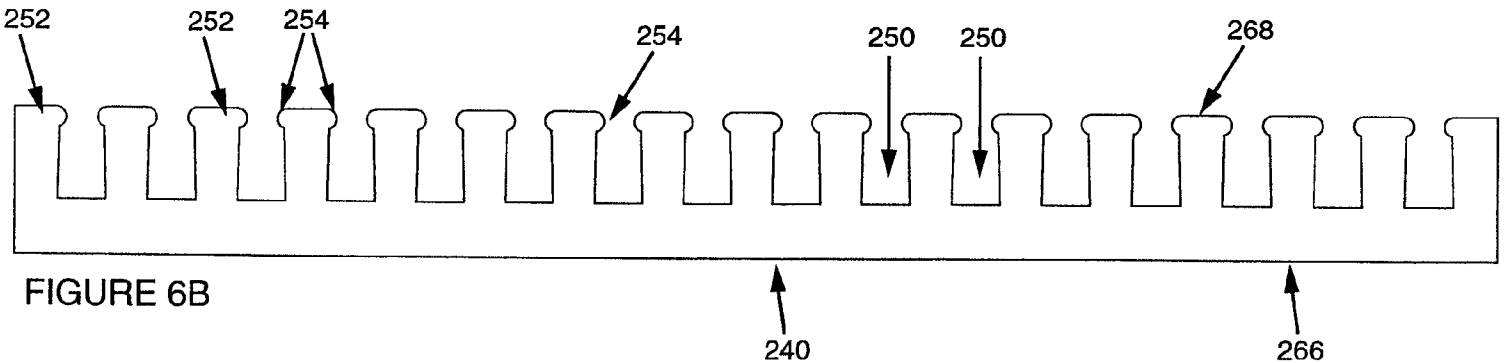
FIG. 6B is a front elevation view of a connector for use with a merchandising system according to another exemplary embodiment.
Figure 6C:
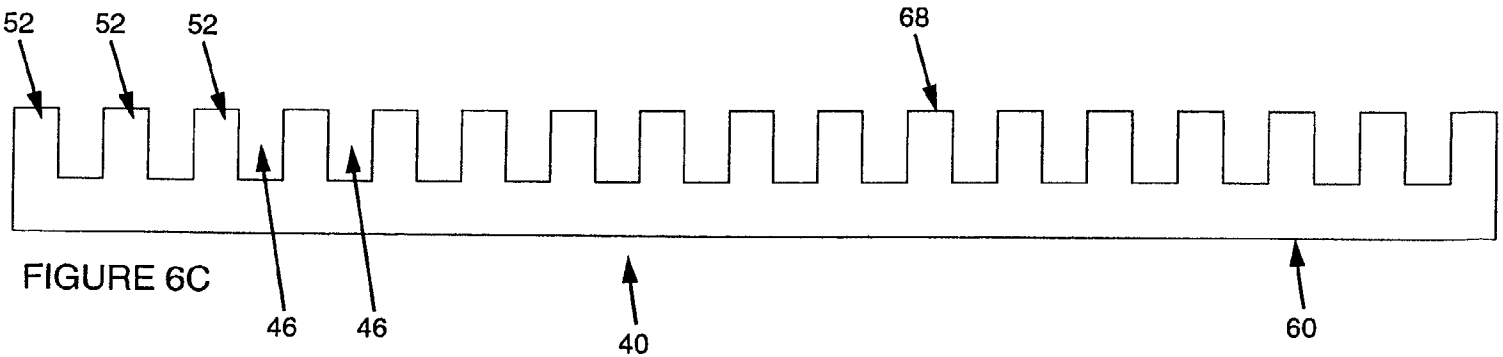
FIG. 6C is a front elevation view of a connector for use with a merchandising system according to still another exemplary embodiment.

According to the exemplary embodiment shown in FIG. 6B, connector 240 may also be constructed by co-extruding a material of a first rigidity (or flexibility) with a material of a second rigidity (or flexibility). According to a particularly preferred embodiment, connector 240 is a dual durometer extrusion having portion 268 (i.e. an upper portion) constructed from a rigid polyvinyl chloride (PVC), and portion 266 (i.e. a lower portion) constructed from a flexible, low tack, or "gummy" PVC. Portion 266 being constructed from a "gummy" material assists merchandising system 10 to stay in place during use by slightly adhering to a support surface such as shelf 80. Similar extrusion processes may be used in the construction and assembly of connectors 40 and 140.

The various configurations of dividers 20 and connectors 40 shown in the FIGURES allow a user to pick and choose dividers for use in constructing merchandising system 10. The different configurations allow for the same basic elements to be used in constructing a wide variety and sizes of merchandising system configurations. For example, one merchandising system configuration may require two end dividers 20*b*, and three center dividers 20*a*. Another merchandising system configuration may require two end dividers 20*b*, five center dividers 20*a*, etc. Any wide variety and configurations of dividers may be used to construct a merchandising system to meet various requirements such as space constraints, product sizes, etc.

Merchandising system 10 may be constructed or assembled by pressing, snapping, engaging, placing, etc. the engaging portions of dividers 20 onto or with connector 40. Connector 40 provide for a relatively simple connection between two divider panels. Dividers 20 shown in FIGS. 1 through 10 may be readily adjusted. Dividers 20 include leg 34 (which may be an interface, projection, extension, etc.) that attaches or couples to an interface (such as notches, teeth, etc. on connector 40). Dividers 20 may be disconnected from an existing interface on connector 40, and then attached, coupled, or coact with another interface at a different spacing. Merchandising system 10 advantageously allows for selected dividers to be adjusted, resized, refaced and/or reconfigured without requiring the adjustment of adjacent dividers or divider sets.

In order for the merchandising system to be configured to display or fit specific products, manufacturers, set of products, etc., the merchandising system may be reconfigured to allow sizing for variously sized products, etc. For example, a first sizing or spacing of dividers may be used for a first product, while a second sizing or spacing of dividers may be used for a second product. According to one exemplary embodiment, connectors may be provided with a continuous, even distribution of interfaces (which may be notches, teeth, etc.). This configuration allows for a merchandising system that is configured to accommodate a wide variety of product sizes. According to one alternative embodiment, a connector may be provided with a limited number of interfaces set apart at predefined distances. For example, a connector (not shown) may be provided with three interfaces providing for three adjustment positions. This configuration may be provided for brand specific merchandising systems, having a predefined number of adjustment positions intended to correlate to a predefined number of products or product sets. According to alternative embodiments, any configuration, arrangement, sizing or distribution of interfaces may be provided.

As shown in FIG. 8, dividers 20 of merchandising system 10 are shown in a first adjustment position. The first adjustment position shown is the minimum spacing for dividers 20 in the exemplary system shown. Leg 34 of divider 20 engages with connector 40. As shown in FIG. 10, dividers 20 are shown in a second adjustment position. The second adjustment position shown is the maximum spacing for dividers 20 in the exemplary system shown. Not shown are a number of adjustment positions available between the first and second adjustment positions, wherein dividers 20 may coact or interface with connectors 40 via any of the notches 50 provided on connector 40.

Shown in FIGS. 12 through 21 is another exemplary embodiment of a merchandising system 310. Merchandising system 310 comprises dividers 320 and connectors or connector modules (shown as connectors 340).

Figure 15:
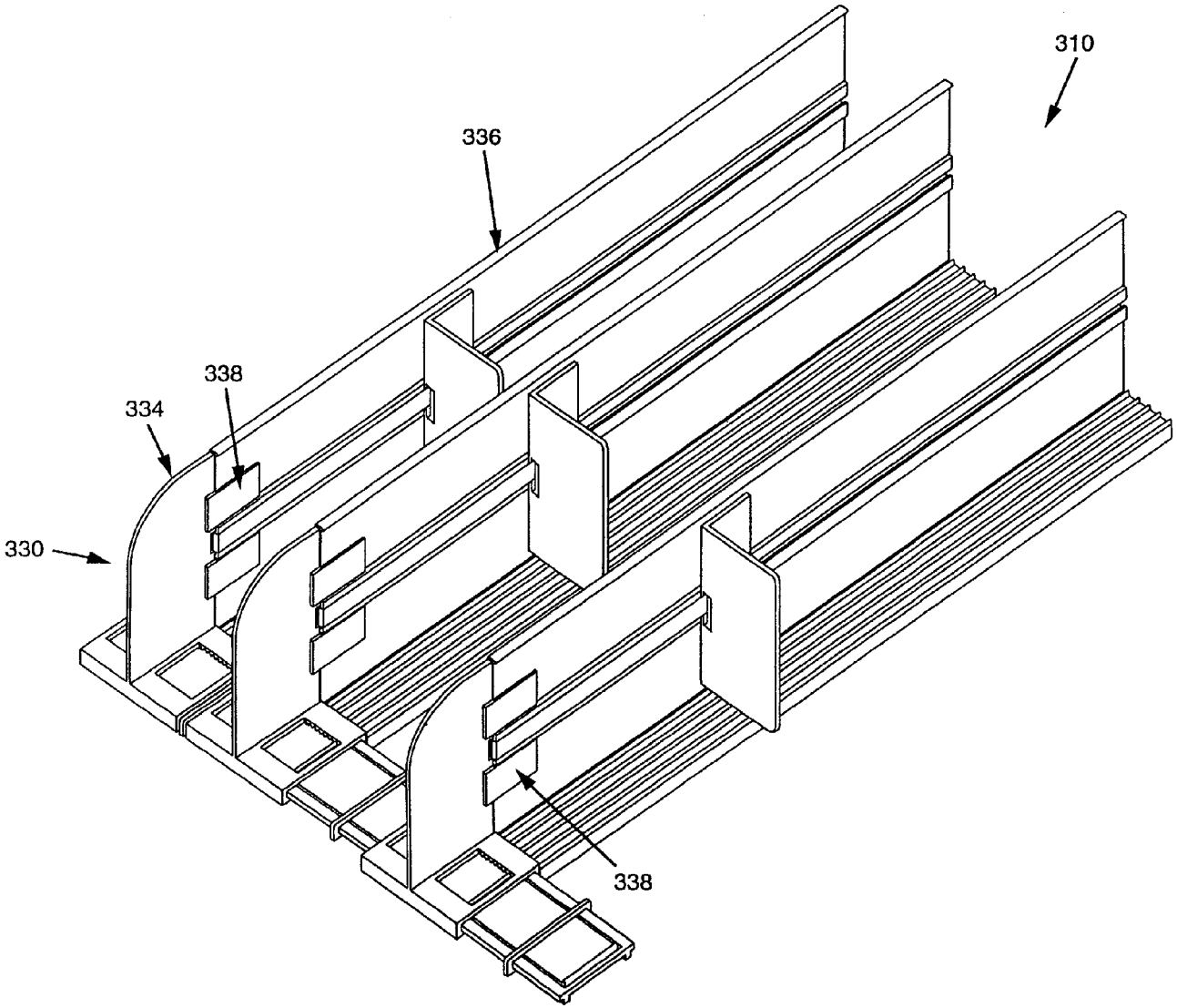
FIG. 15 is a perspective view of the merchandising system according to the second exemplary embodiment, shown with second sized connectors.
Figure 16:
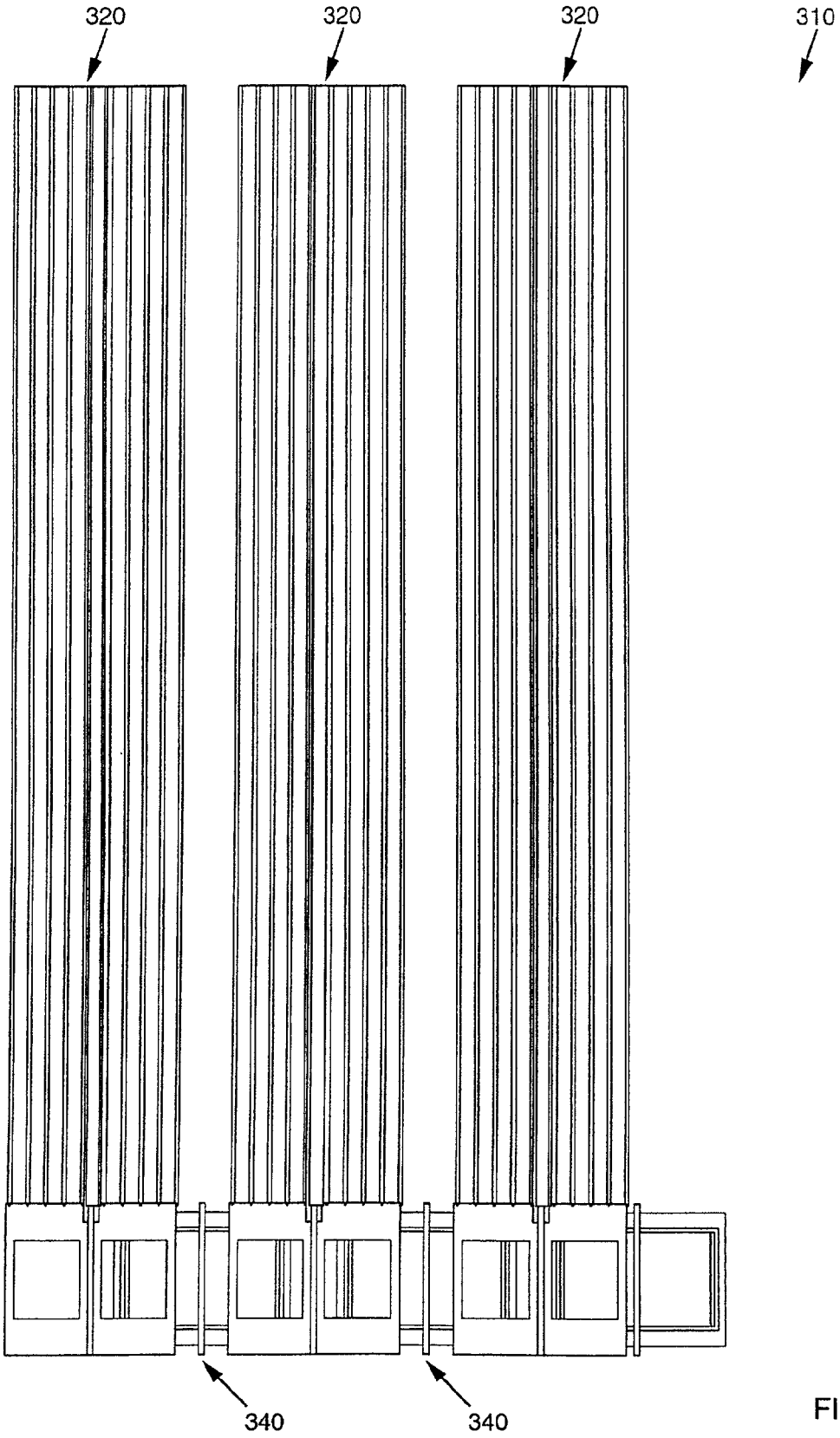
FIG. 16 is a top plan view of the merchandising system shown in FIG. 15.

Divider 320 may comprise a frame section 330 having a base 332 and a post 334, and a panel section 336. As shown in FIG. 15, post 334 of frame section 330 attaches to an end of panel section 336. Tabs or fingers (shown as tabs 338)

provided on post 334 wrap around both sides of panel section 336 to attach frame section 330 to panel section 336. Projections may be provided on tabs 338 to fit into holes provided on panel section 336 in order to provide a more secure attachment. (See FIG. 17).

Figure 17:
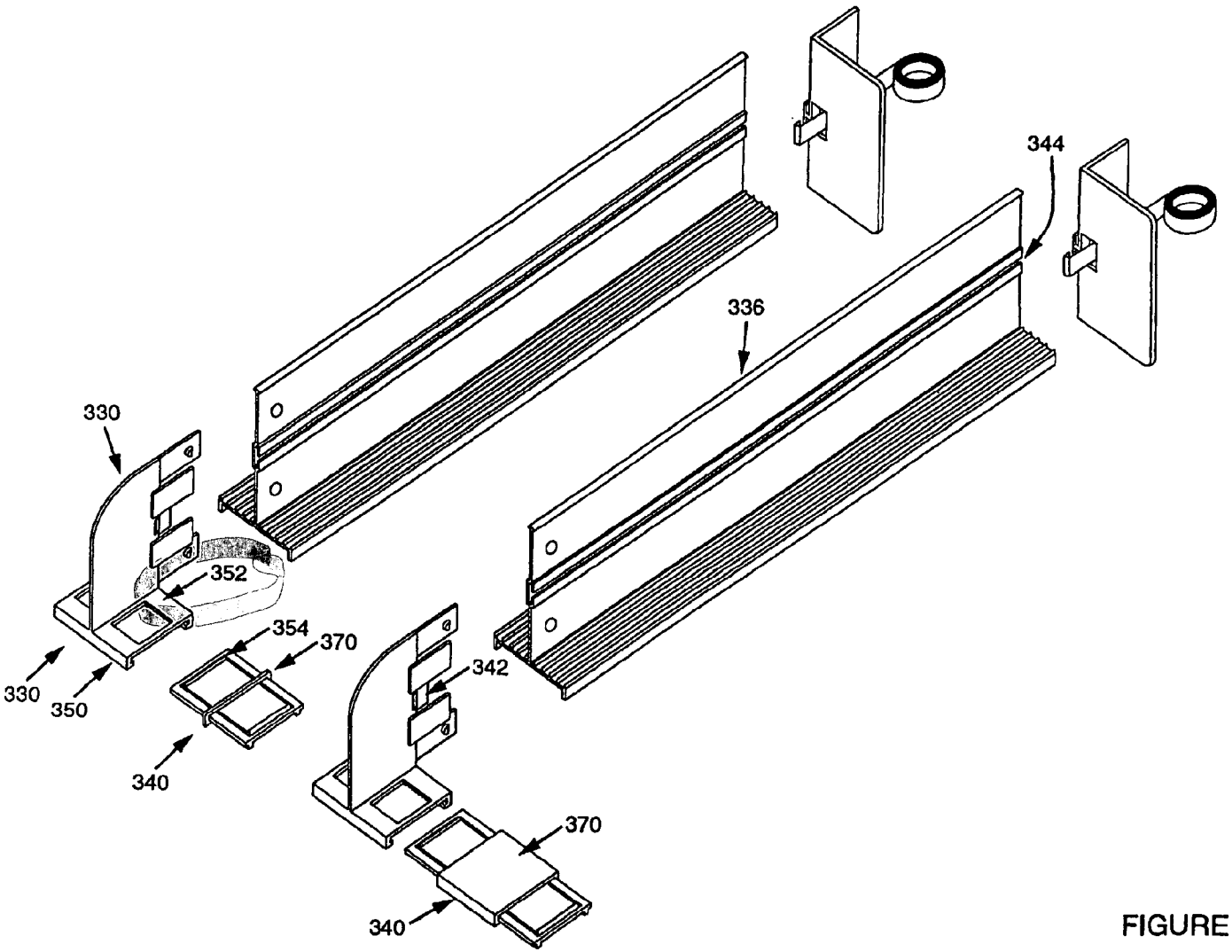
FIG. 17 is an exploded view of the merchandising system according to the second exemplary embodiment, shown with first and second sized connectors.
Figure 18:
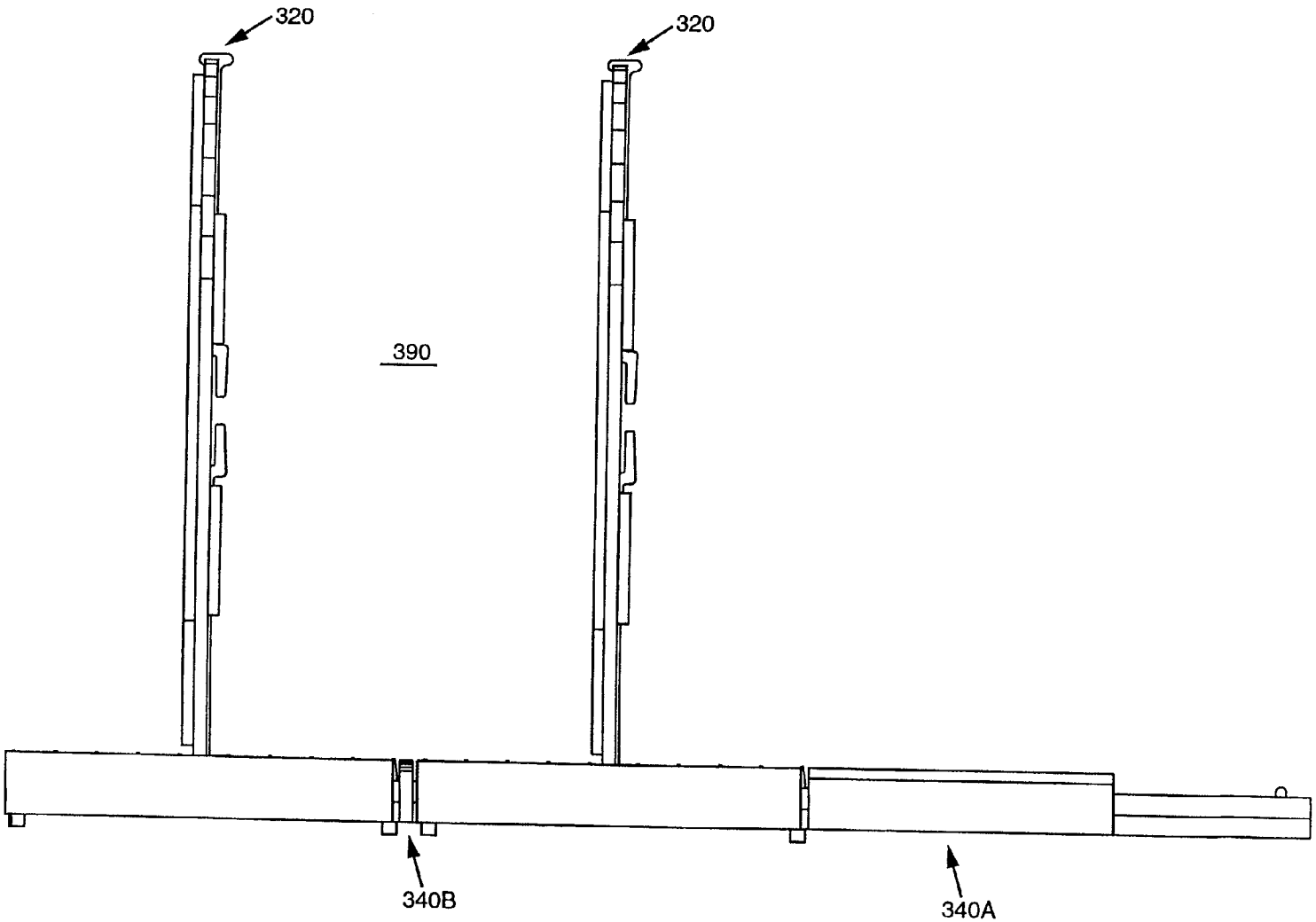
FIG. 18 is an assembled front elevation view of the merchandising system shown in FIG. 17.

Post 334 of frame section 330 may also include a tab, extension, or channel insert (shown as tab 342) which is inserted into an end of a slot 344 in panel section 336 (see FIG. 17).

As shown in FIG. 17, a base 350 is provided on a bottom end of frame section 330. Base 350 provides an interface 352 for selective engagement with an interface 354 of connector 340. Interface 352 may provide teeth 356 (which may be recesses, apertures or notches, projections, tabs, interconnects, etc.) (see FIG. 19B) sized and configured to engage interface 354 on connector 340 (e.g. flange 362) (see FIG. 20).

Figure 19A:
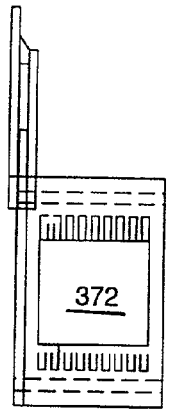
FIG. 19A is a top plan view of a frame member for use with the merchandising system shown in FIG. 12.
Figure 19B:
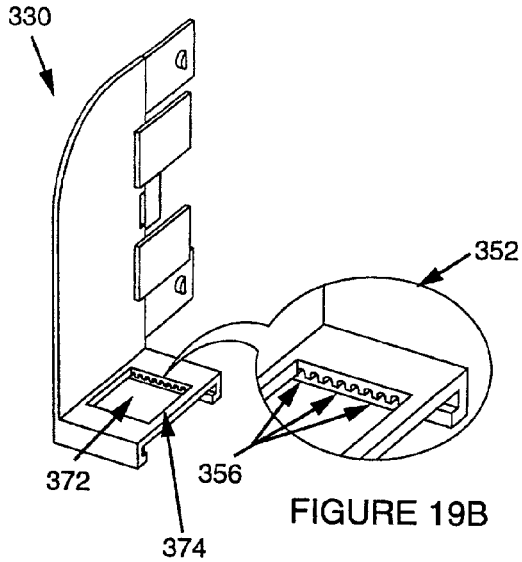
FIG. 19B is a perspective view of the frame member shown in FIG. 19A.
Figure 19C:
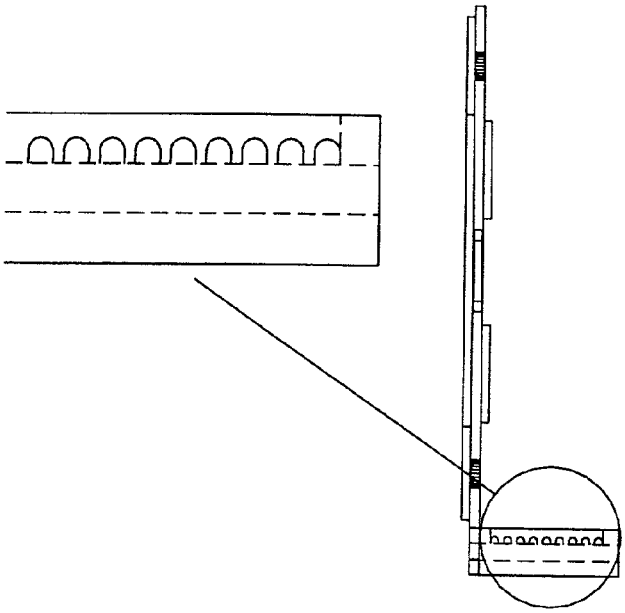
FIG. 19C is a front elevation view of the frame member shown in FIG. 19A.
Figure 19D:
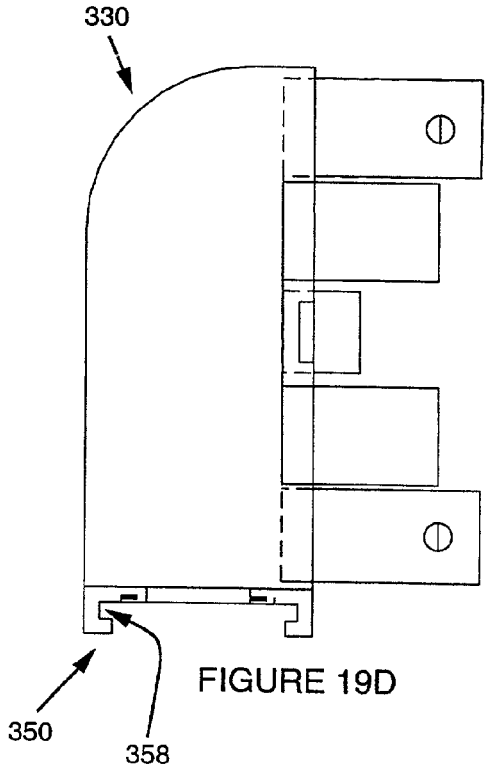
FIG. 19D is a side elevation view of the frame member shown in FIG. 19A.

As shown in FIGS. 19D and 21B, a guide 358 (which may be a track, alignment guide, slot, rail, etc.) is provided on base 350 of frame section 330 to engage a corresponding guide 360, (which may be a slot, track, or rail) on connector 340. Frame section 330 may generally be made from injection molded plastic.

According to one exemplary embodiment shown in FIG. 17, one or more connectors 340 may be provided with merchandising system 310. Connector 340 may provide an interface 354 (which may be a coupling, connecting member, coupling member, etc.) for engagement with frame section 330. As shown in FIG. 21B, connector 340 includes a flange 362 (which may be a tab, arm, cantilevered extension, etc.). Flange 362 is configured to be movable (e.g. actuated, deformed or depressed). According to an exemplary embodiment, flange 362 will be flexible as to allow temporary deformation when a load is applied (e.g. by depressing) and will return to the original form (e.g. spring back) when the load is removed. Flange 362 is shown as a cantilever, but may be provided in alternative orientations. A tab or projection 364 on flange 362 is sized to fit into gap 356 on base 350 of frame section 330. Flange 362 is shown as a cantilever, but may be provided in alternative orientations. A tab or projection 364 on flange 362 is sized to fit into gap 352 on base 350 of frame section 330.

As shown in FIG. 17, a cross member 370 may be provided to add rigidity or strength to connector 340. Furthermore, cross member 370 may serve as a "stop" to bound the movement of flange 362 of connector 340 into a recess of frame section 330.

Figure 22:
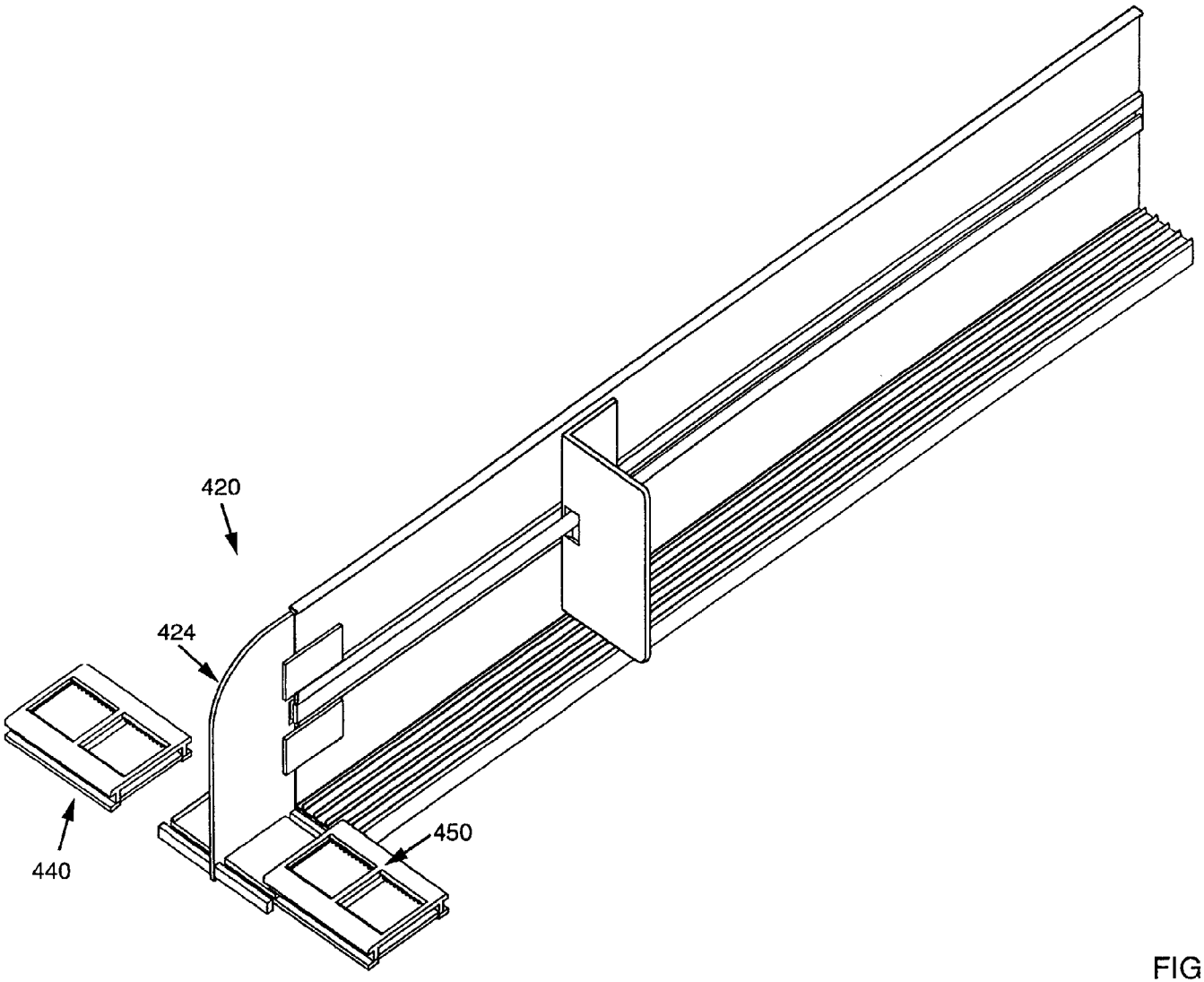
FIG. 22 is a partial exploded view of two connectors interfacing with a divider of a merchandising system according to a third exemplary embodiment.

As shown in FIGS. 21 through 22, the width of cross member 370 may be varied. A wider cross member (e.g. cross member 370*a*) may be used when the spacing between adjacent panels 336 is desired to be greater (i.e. a wider cross member may be associated with the use of wider products or spacing). A narrower cross member (e.g. cross member 370*b*) may be used when the spacing between adjacent panels 336 is desired to be lessened (i.e. a narrower cross member may be associated with the use of narrower products or spacing).

Figure 23:
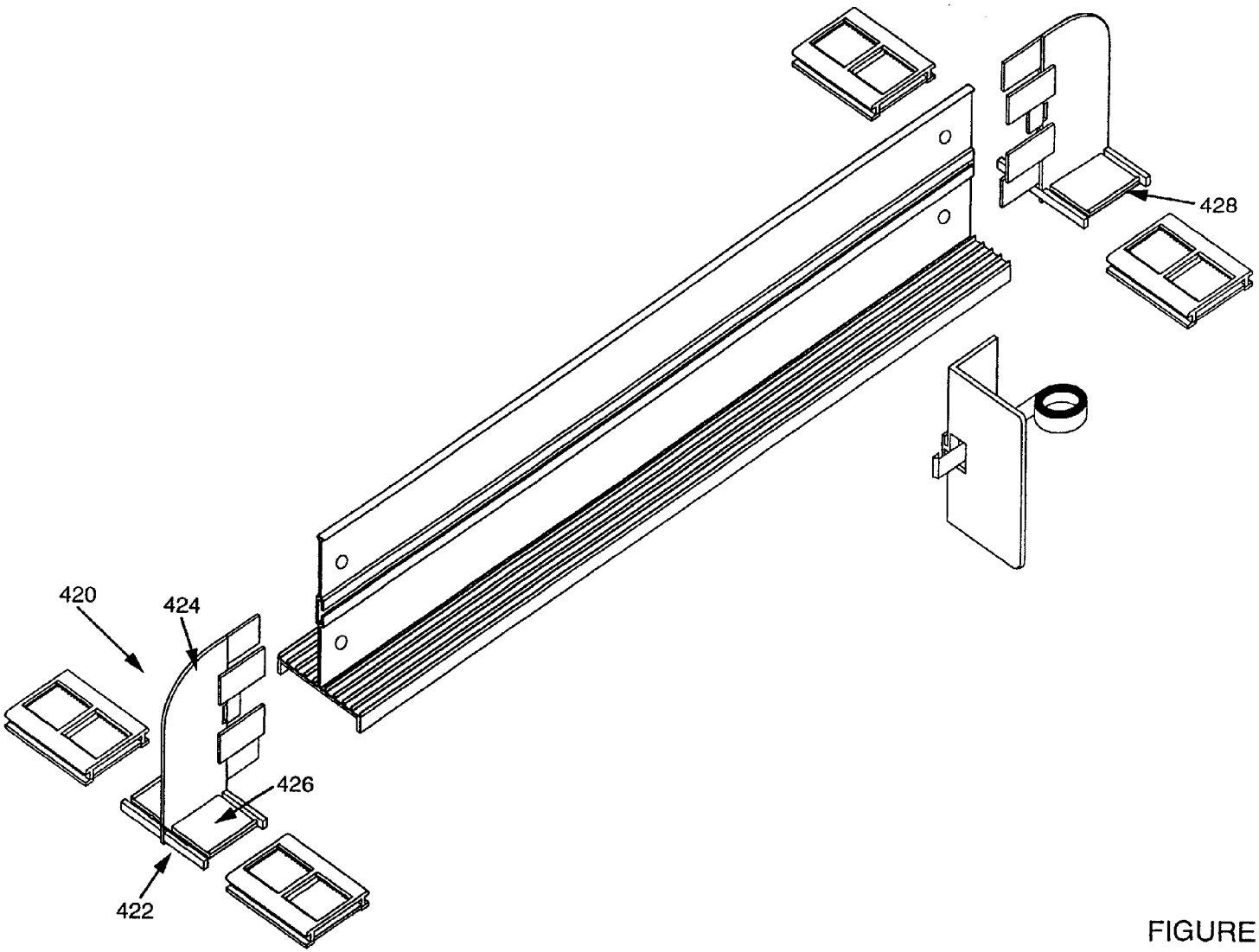
FIG. 23 in an exploded view of four connectors interfacing with a divider of the merchandising system according to the third exemplary embodiment.

As shown in FIG. 22D, a guide 360 (which may be a track(s), rail(s), slot(s), etc.) may be provided on connector 340. Flange 362 of connector 340 may be depressed and/or deformed to disengage projection 364 from interface 352 on base 350 of frame section 330. According to a particularly preferred embodiment, connector 340 is configured to engage one or more frame members 330. According to an alternative embodiment, two connectors may be provided to attach two adjacent dividers. For example, a connector may be provided toward the front of the dividers, and another connector may be provided toward the back of the dividers. (Similar to FIG. 23).

Connector 340 (shown in FIGS. 20 through 21) may be constructed or assembled in a single body from injection molded plastic. Connector 340 may alternatively be constructed from separate pieces then assembled or attached using a sonic welding process (or other suitable attachment technique such as adhesives, etc.).

A variety of plastics may be used in constructing divider 320, frame section 330 and connector 340. For example, divider 320, frame section 330 and connector 340 may be constructed from plastics, polymers, high-impact plastics and the like. Using plastic offers several advantages including that the pieces are moldable in a variety of different colors, surface finished, textures, etc.

According to various alternative embodiments, frame section 330 may be provided with a left hand orientation or a right hand orientation as described above to act as end pieces for merchandising system 310.

According to one exemplary embodiment shown in FIG. 12, frame section 330 interconnects each divider 320 to a connector 340. Frame section 330 is coupled and fixed with respect to the divider 320.

Frame section 330, and thus divider 320, are adjusted as follows. Connector 340 includes an interface providing a flange 362 (with projection 364) that is actuated by being depressed, (e.g. bent or deformed) to a deformed form to disengage projection 364 from teeth or gaps 356 in frame section 330. Frame section 330 and connector 340 are then free to move relative to each other (e.g. move along or slide in the guides formed in the connector, as well as within the recess or opening in the frame section 330).

Access to flange 362 of connector 340 is through an opening 372 in a cover 374 of base 350 of frame section 330. Once frame section 330 (and divider 320) is moved to a desired location, flange 362 is released and allowed to return to its original form in which projections 364 again engage corresponding teeth or gaps 352 on frame section 330. Flange 362 on connector 340 will coact with teeth or gaps 356 on base 350 of frame section 330 to secure dividers 320 in a selected position.

Connector 340 may be advantageously allow for simple and convenient construction. Connector 340 may not require "undercuts" or "side actions" in its construction (i.e. movable parts in a mold that must be moved prior to the part being released from the mold). Thus the connector is easier to mold, costs less to mold, production times for producing the connector are reduced, the mold is less complicated and requires fewer parts, etc.

Additionally, connectors may be provided in variable lengths. This allows the merchandising system to accommodate products and shelving spacing of varying dimensions. Longer connectors are used where wider shelf spacing is desired, and shorter connectors are used where narrower shelf spacing is desired.

Shown in FIGS. 22 through 35 is another exemplary embodiment of a merchandising system 410. Merchandising system 410 comprises dividers 420 and connectors or connector modules (shown as connector 440).

Figure 24:
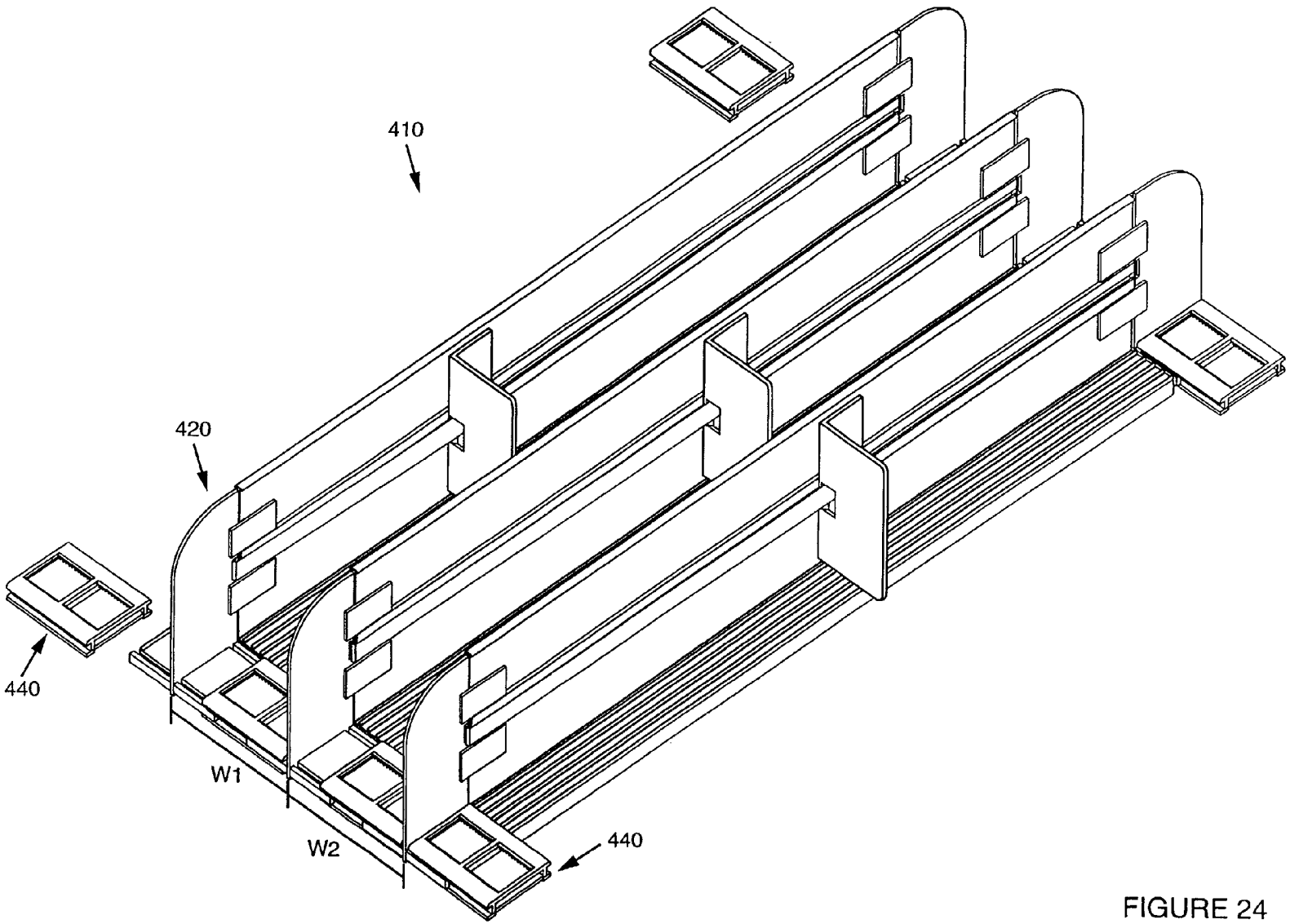
FIG. 24 is a perspective view of the merchandising system according to the third exemplary embodiment, showing adjustment positions of the dividers.

As shown in FIG. 24, divider 420 may be substantially similar in configuration and arrangement as divider 320 shown in FIG. 12. However, divider 420 may be provided with a base 422 on a frame section 424 that includes a flange 426 similar to flange 362 provided on connector 340 as shown in FIG. 21. Flange 426 is configured to be movable (e.g. actuated, deformed or depressed), and preferably will be flexible as to allow temporary deformation when a load is applied (e.g. by depressing) and will return to the original form (e.g. spring back) when the load is removed. Flange 426 is shown as a cantilever, but may be provided in alternative orientations.

Figure 31:
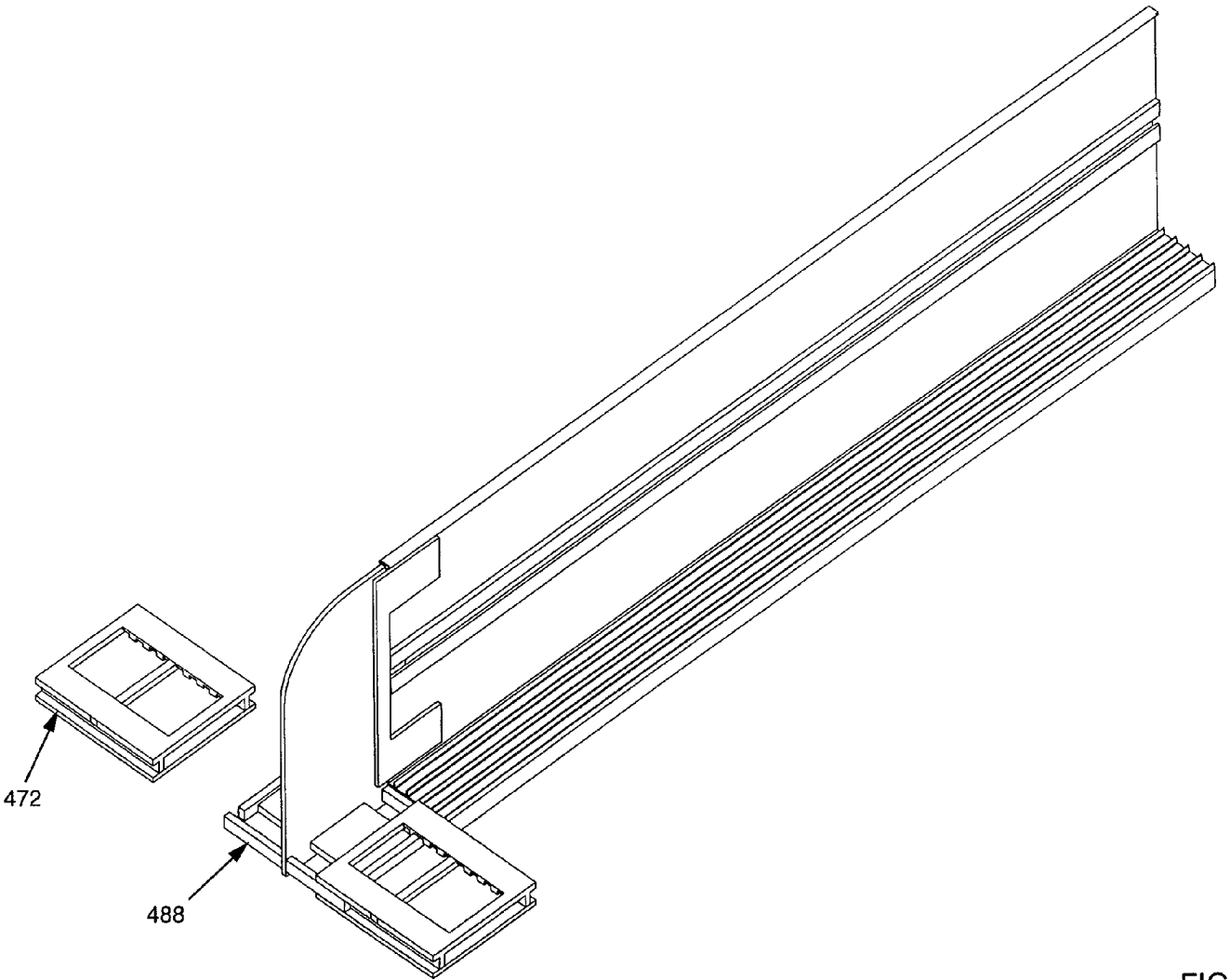
FIG. 31 is a partial exploded view of a merchandising system according to the third exemplary embodiment.

Flange 426 may provide projections 428 (which may be a tabs, interconnects, etc.) sized and configured to engage an interface 442 on connector 440 (which may be recesses, apertures, notches, etc.). Connector 440 may provide an interface 448 (which may be a coupling, connecting member, coupling member, etc.) for engagement with frame section 424 of divider 420. As shown in FIG. 31, divider 420 may further comprise a guide, teeth, alignment member, etc., shown as member 488.

Figure 32:
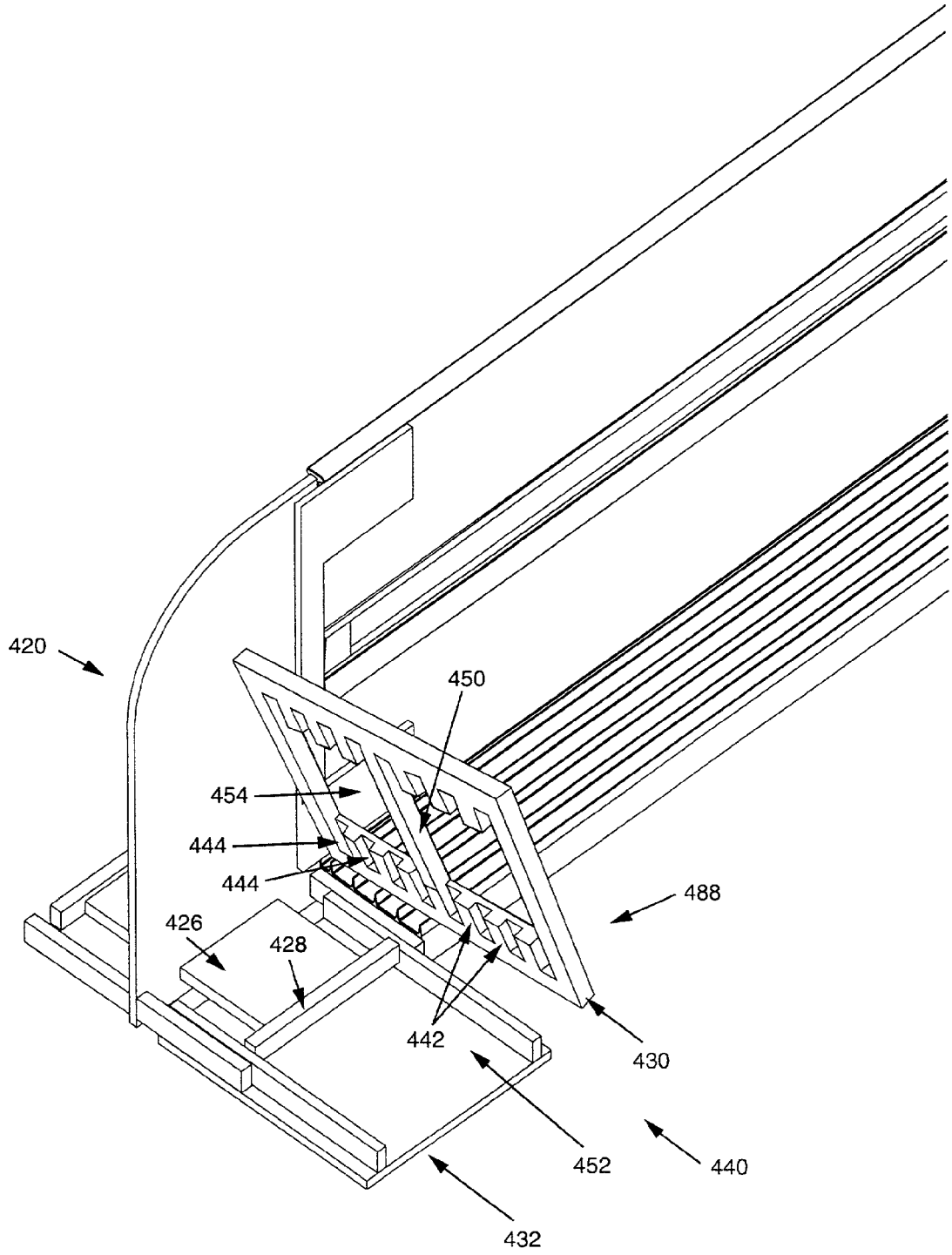
FIG. 32 is a partial exploded view of a merchandising system according to the third exemplary embodiment.
Figure 33:
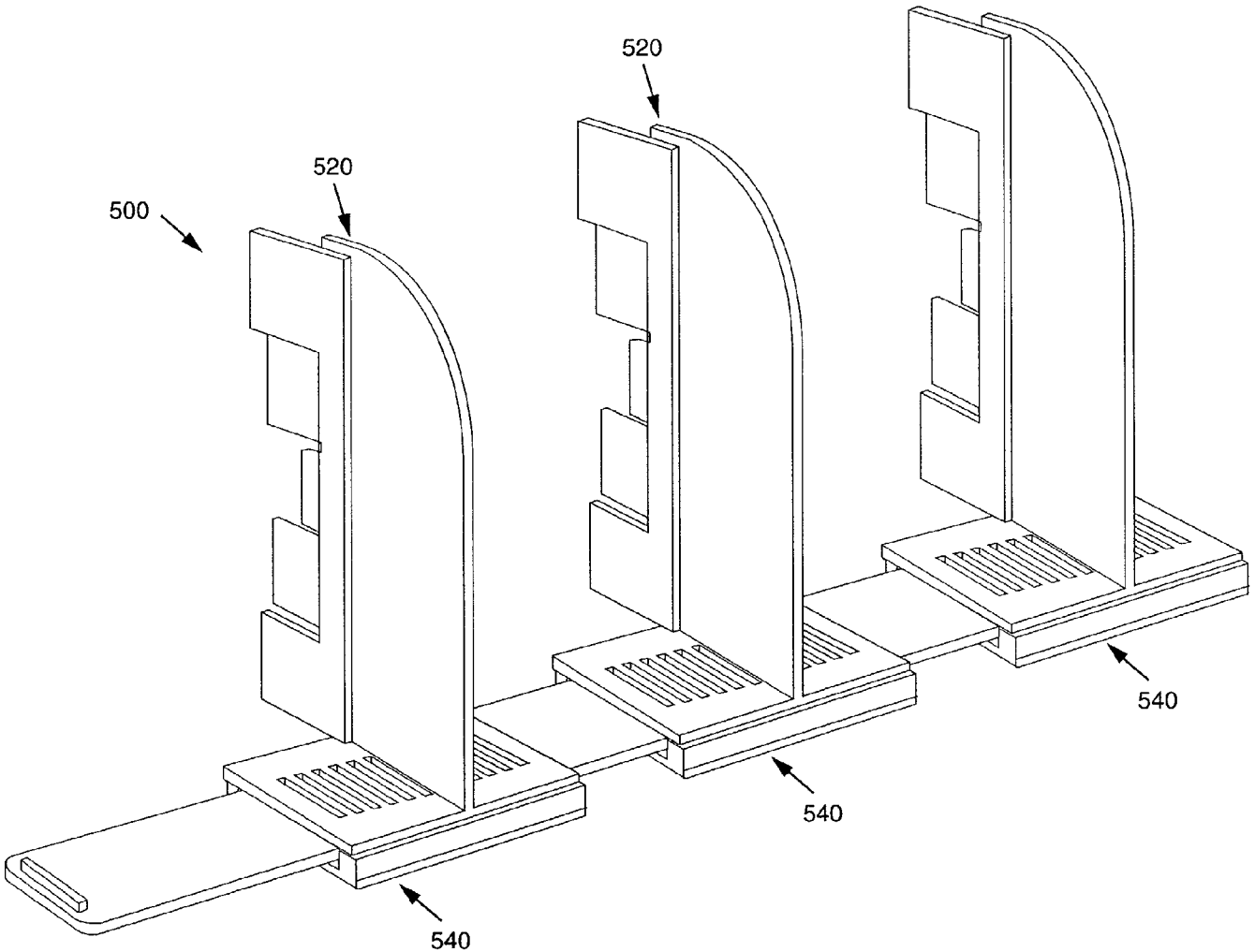
FIG. 33 is perspective view of a panel member and a connector according to an alternative embodiment.
Figure 34:
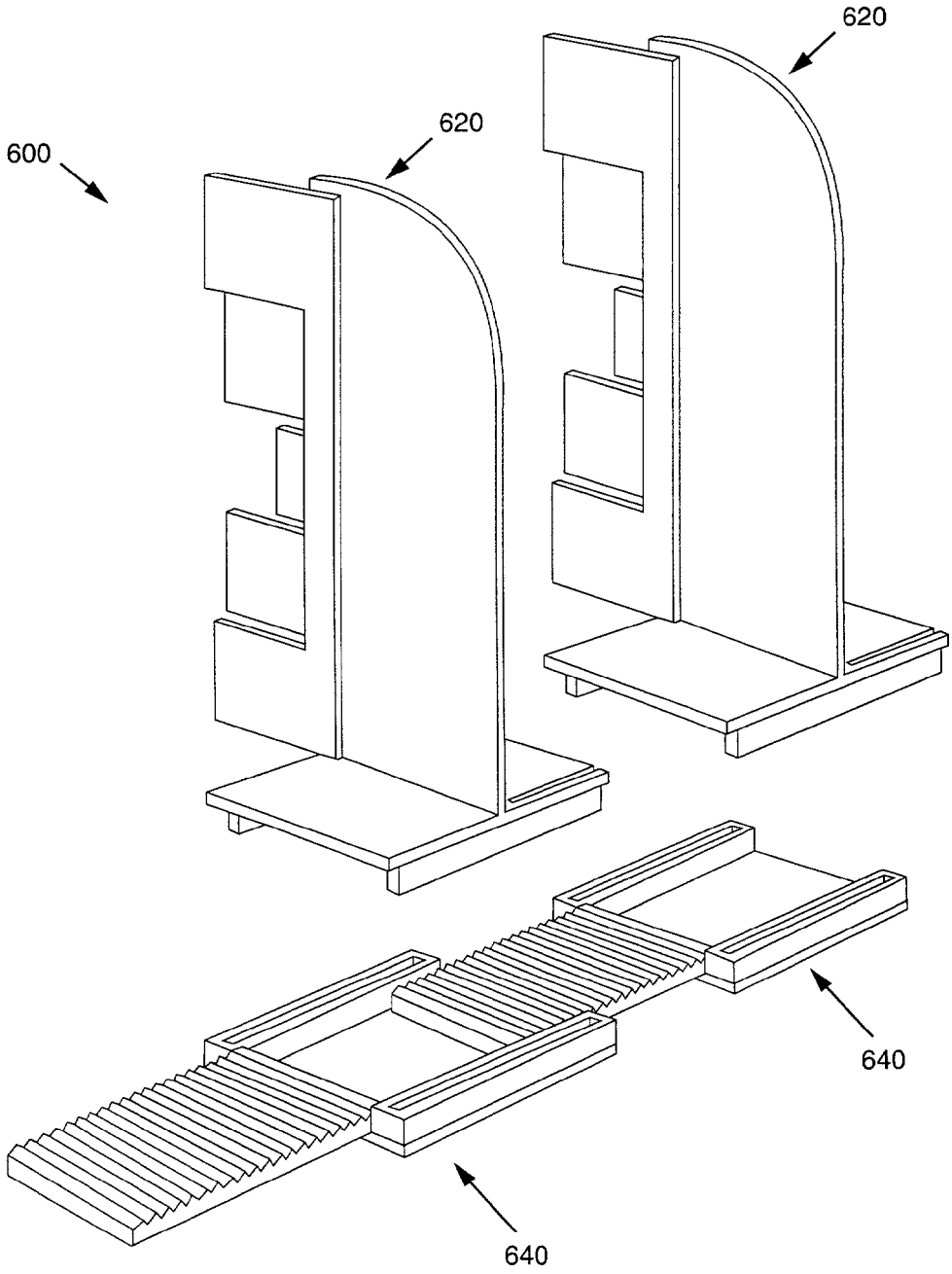
FIG. 34 is an exploded view of a panel member and a connector according to an alternative embodiment.
Figure 35:
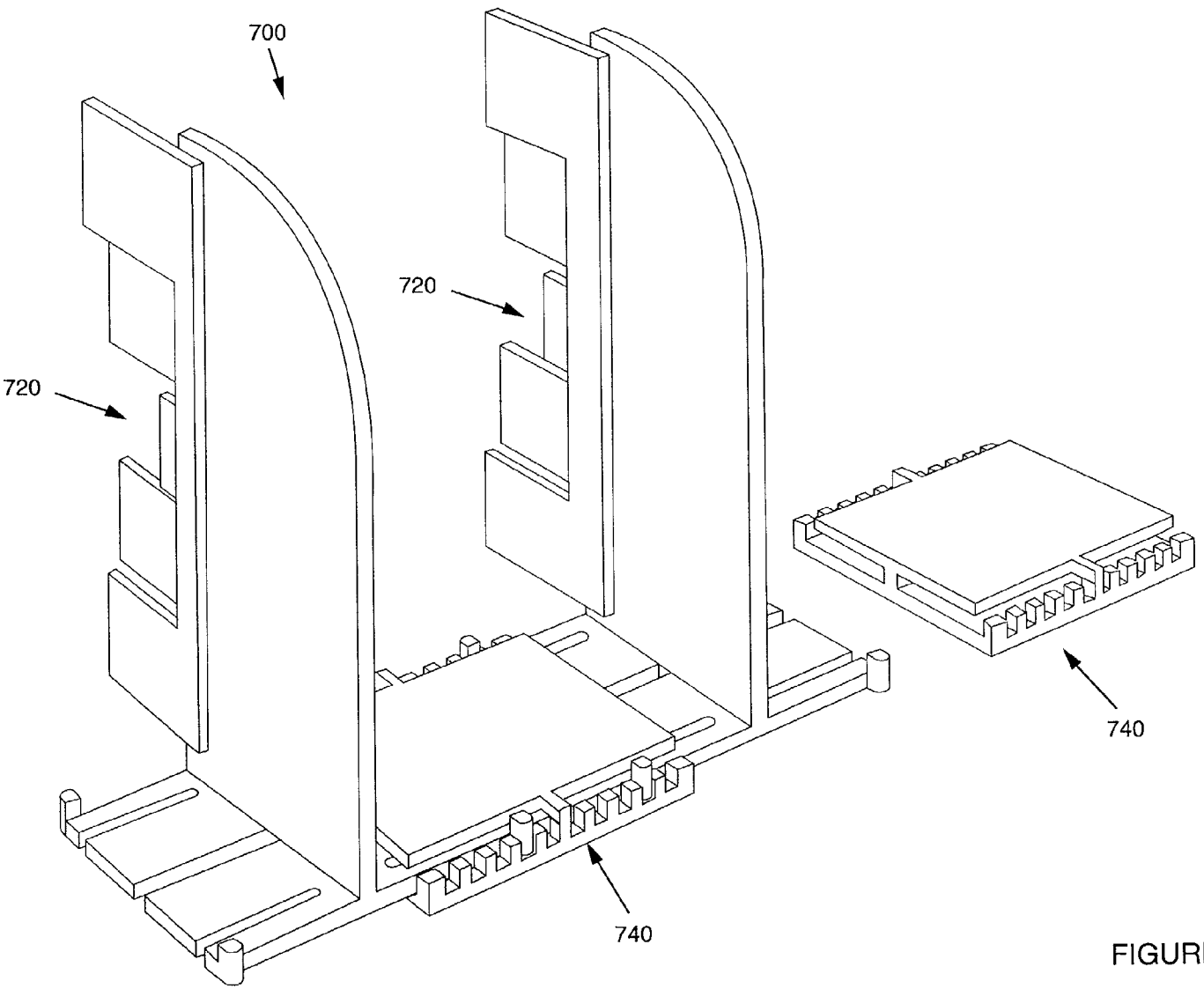
FIG. 35 is perspective view of a panel member and a connector according to an alternative embodiment.
Figure 36:
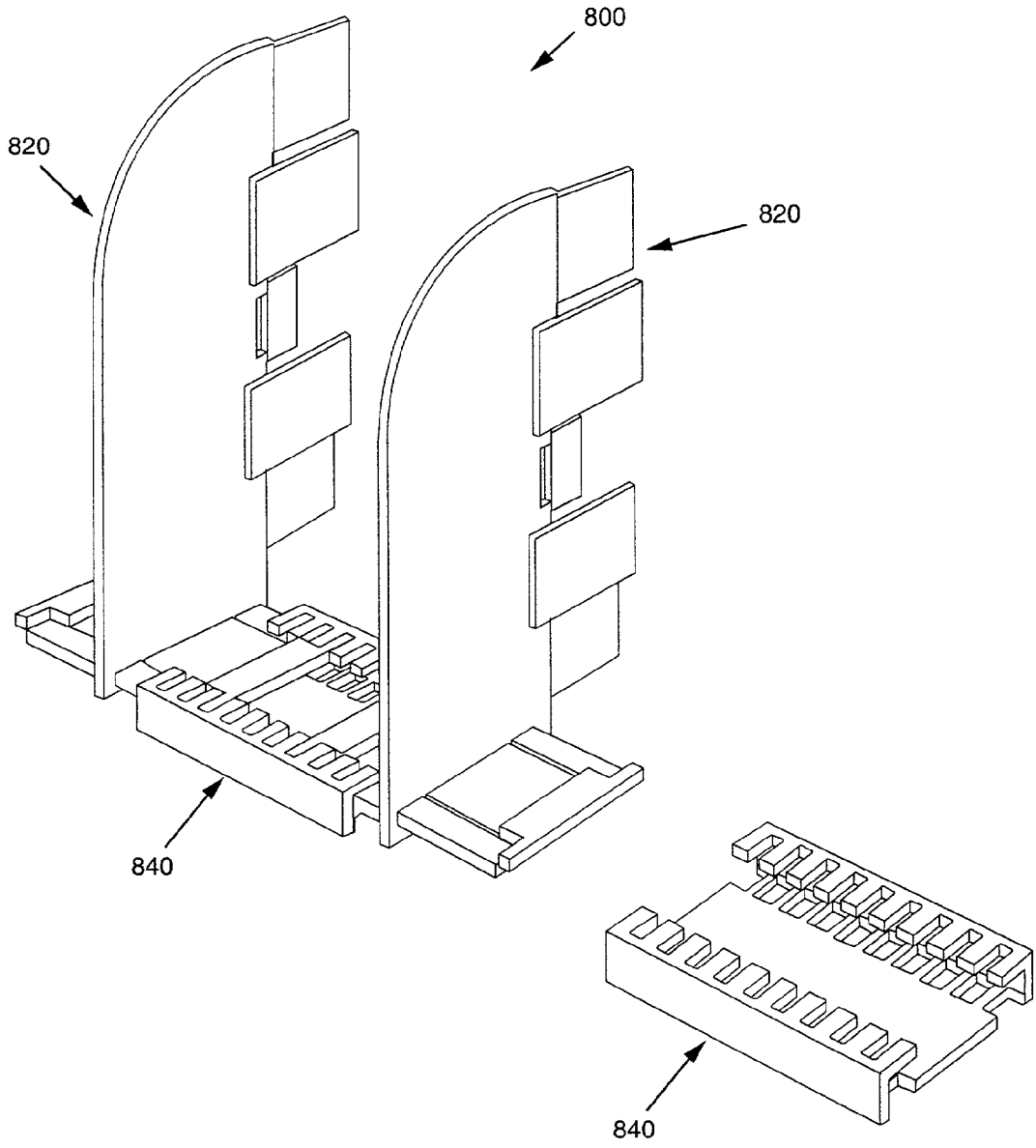
FIG. 36 is perspective view of a panel member and a connector according to an alternative embodiment.
Figure 37:
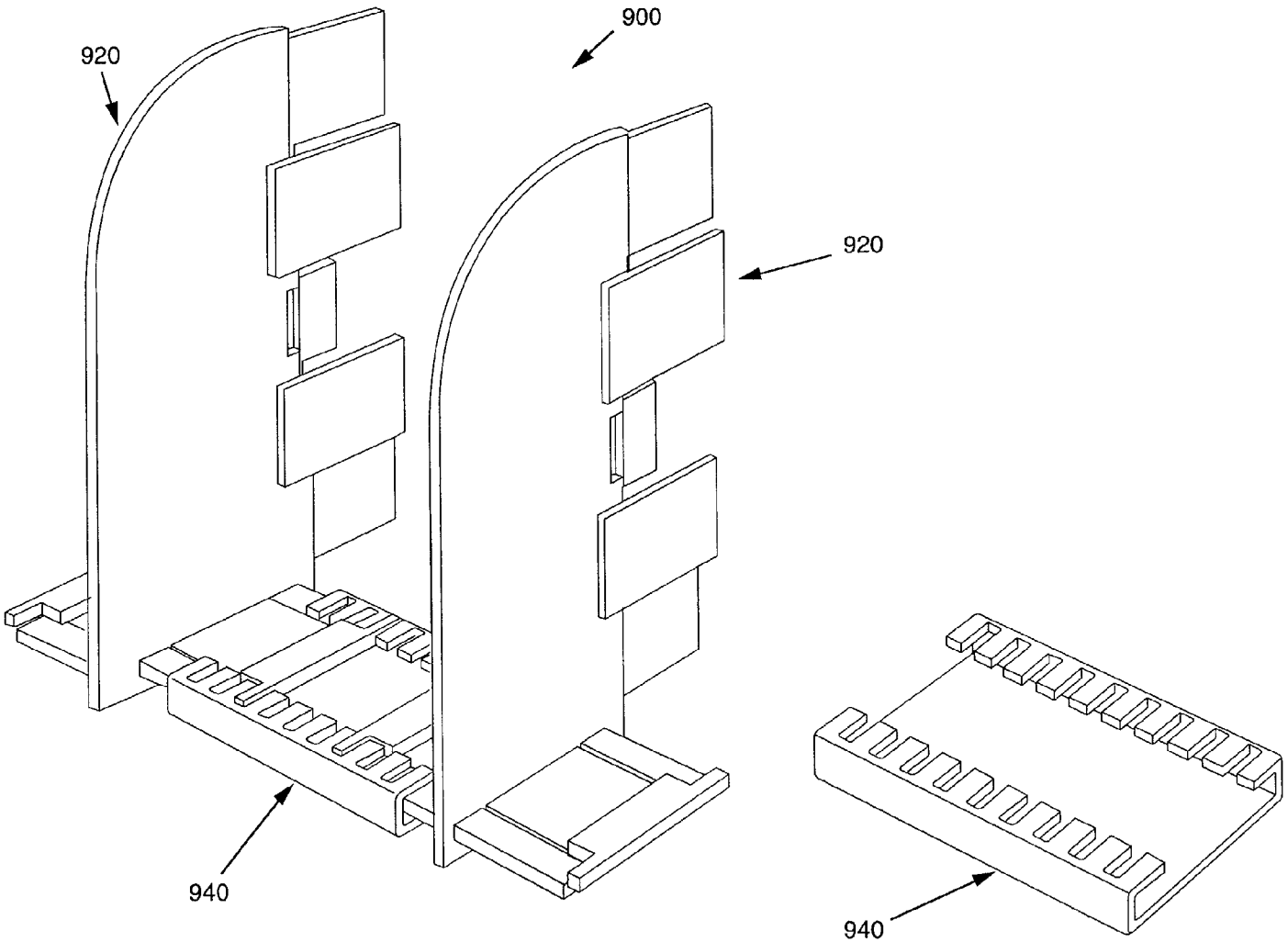
FIG. 37 is perspective view of a panel member and a connector according to an alternative embodiment.

According to the exemplary embodiment shown in FIG. 32, connector 440 comprises a cover 430 coupled or attached to a base 432. Projections 442 (which may be gaps, tabs, teeth, notches, etc.) are provided on one or more sides of cover 430. As shown in FIG. 32, projections 442 are disposed on a bottom surface of cover 430. Projections 442 may be placed on other surfaces and in other configurations alternatively. Between projections 442, are gaps 444 configured to engage projections 428 of flange 426.

A cross member 450 may be provided to rigidify connector 440 and/or to serve as a "stop" to bound the movement of flange 426 into a recess 452 of connector 440. As shown in FIG. 32, openings 454 in cover 430 allow access to actuate flange 426.

Connector 440 may be constructed from injection molded plastic. Generally, base 432 and cover 430 may be formed separately, and then may be connected using a sonic welding process (or other suitable attachment technique).

As shown in FIG. 32, an opening or channel (shown as opening 454) may be provided between cover 430 and base 432 to allow the insertion and movement of flange 426 and thereby selective adjustment of divider 420. Flange 426 may be depressed and deformed to disengage projections 428 from gaps 444 in cover 430 of connector 440.

Connector 440 may be configured to engage one or more dividers 420. Frame section 424 of divider 420 interconnects each divider 420 to one or more connectors 440.

Figure 25:
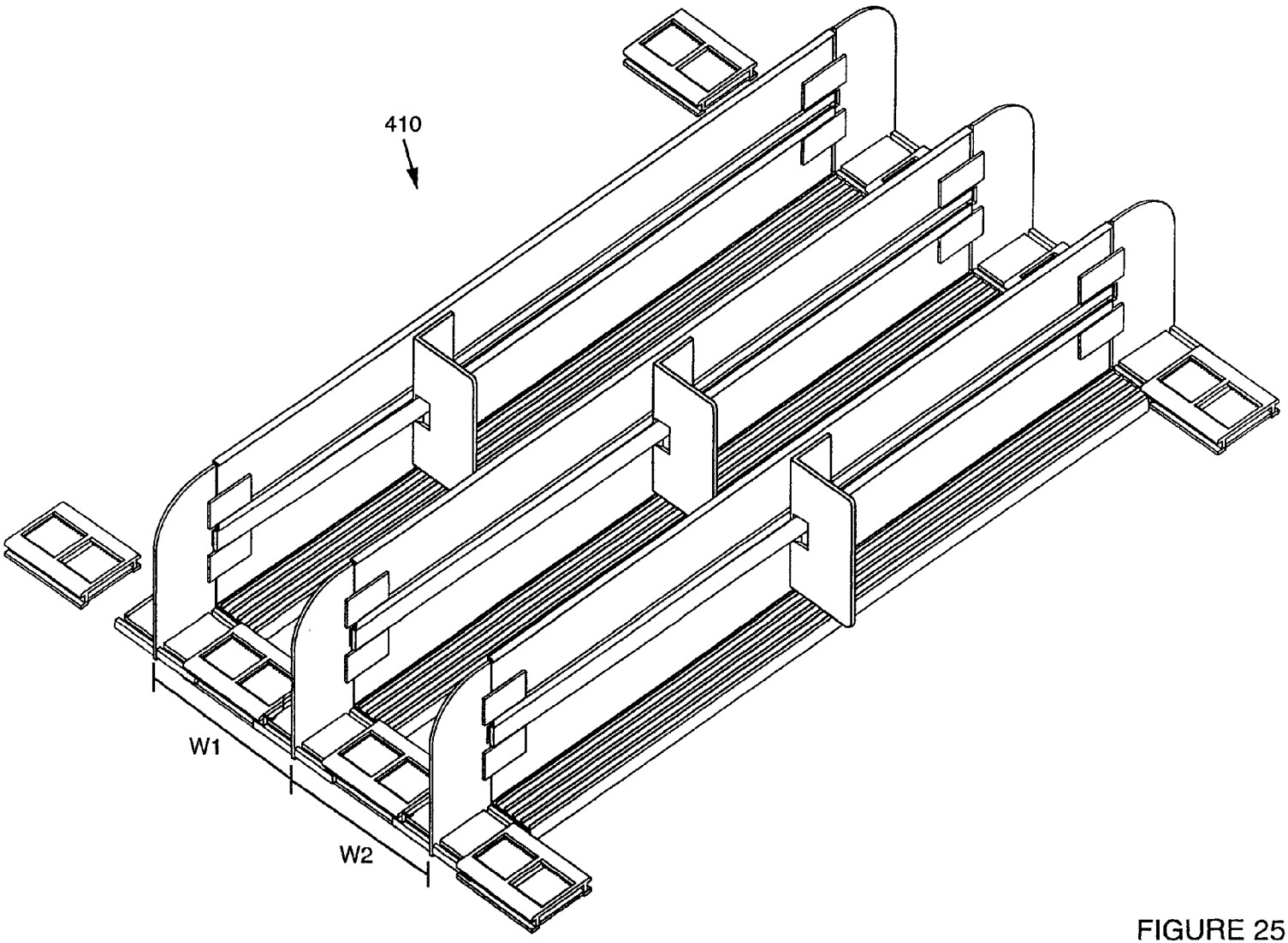
FIG. 25 is a perspective view of the merchandising system shown in FIG. 24, showing additional adjustment positions.
Figure 26:
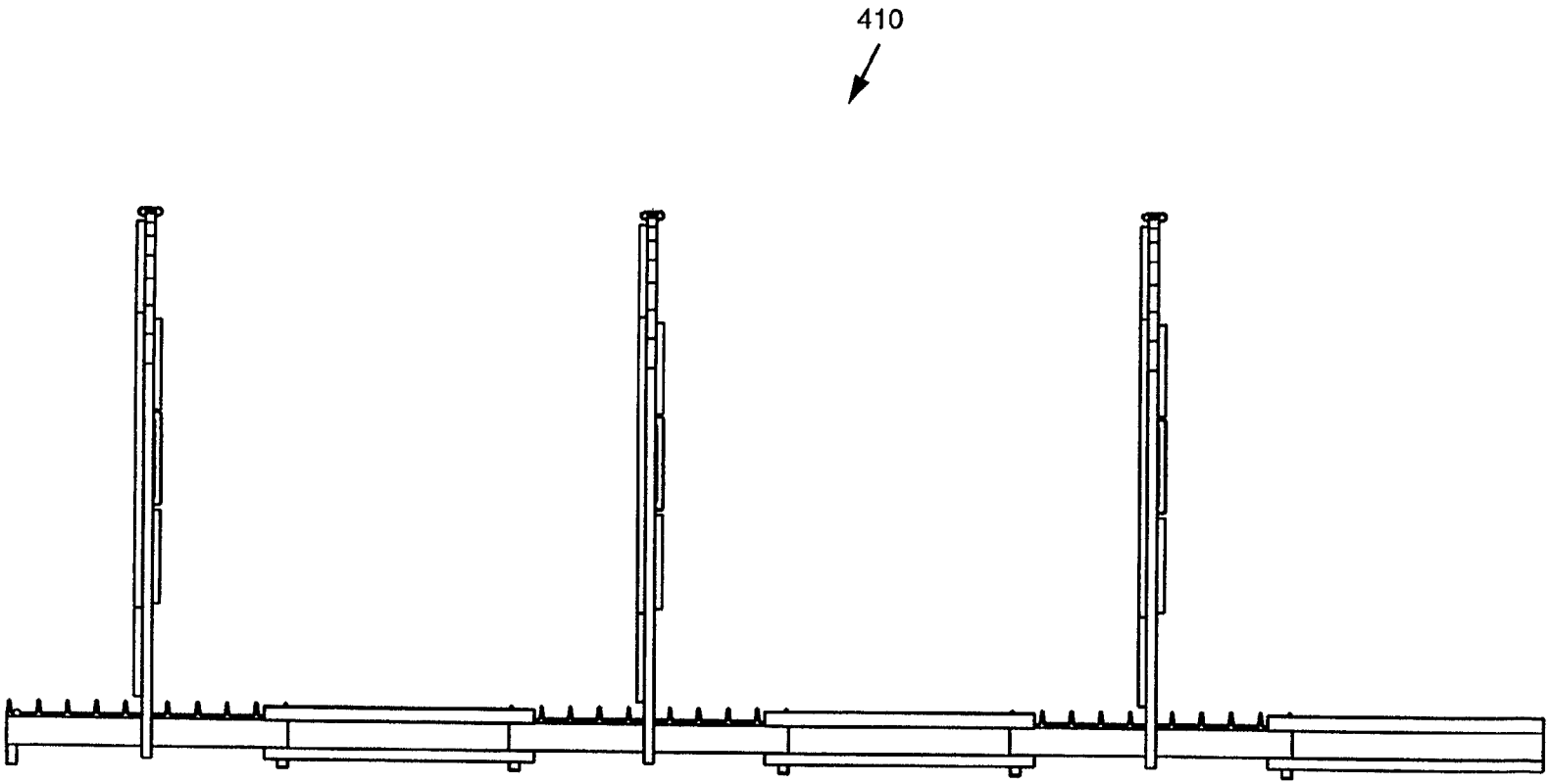
FIG. 26 is a front elevation view of the merchandising system according to the third exemplary embodiment, showing an adjustment position.
Figure 27:
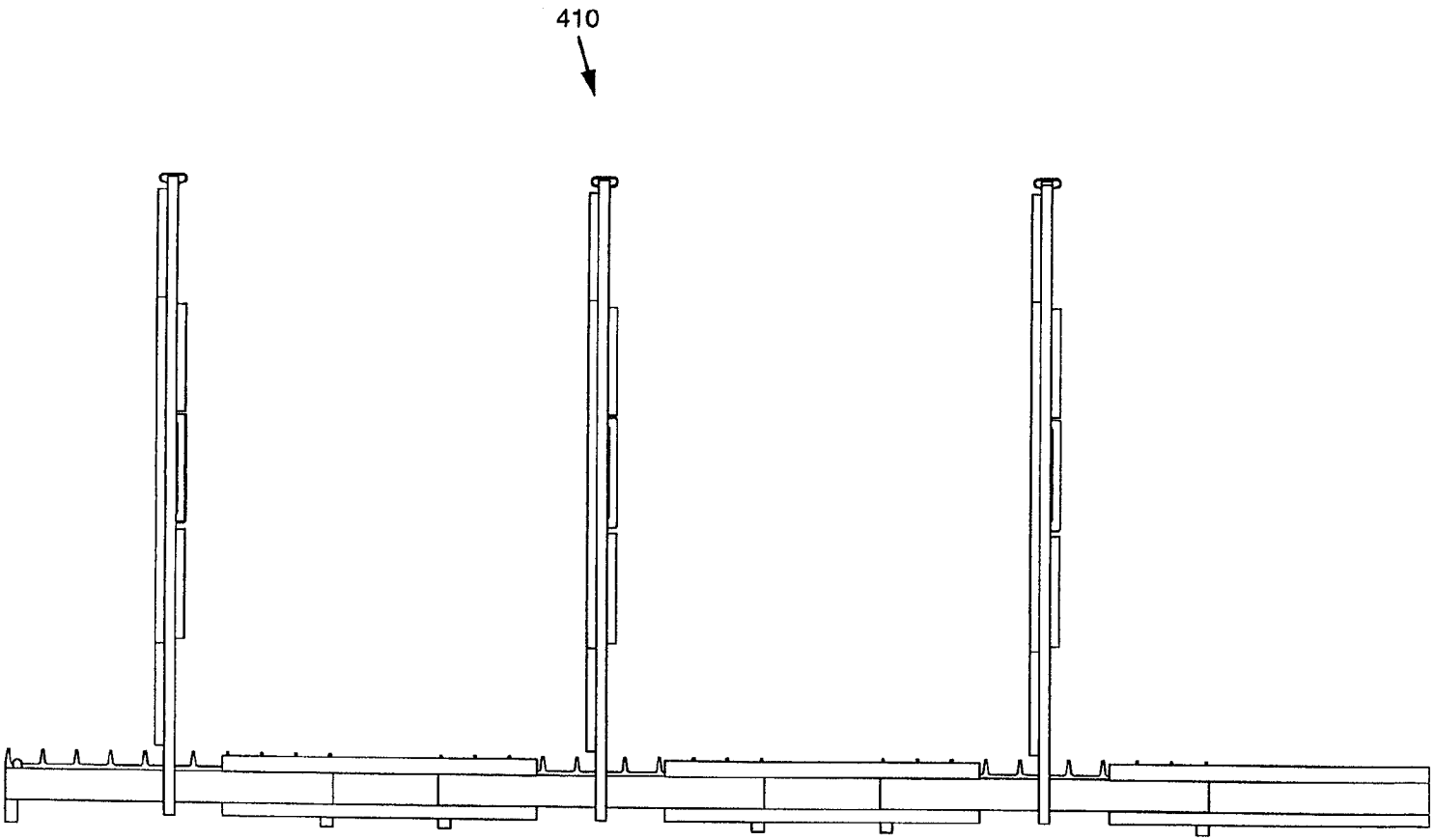
FIG. 27 is a front elevation view of the merchandising system according to the third exemplary embodiment, showing another adjustment position.
Figure 28:
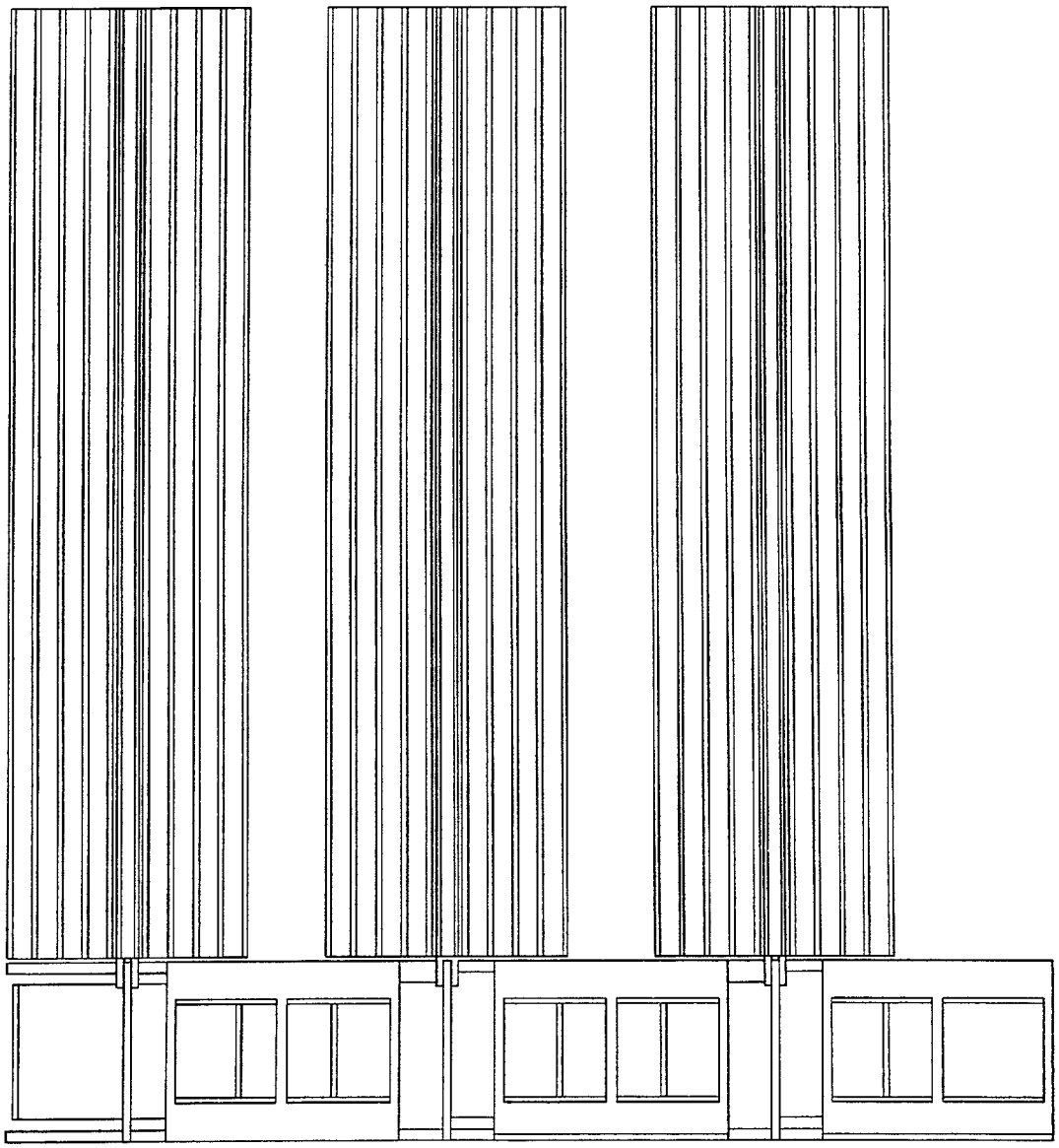
FIG. 28 is a top plan view of the merchandising system according to the third exemplary embodiment, showing another adjustment position.
Figure 29:
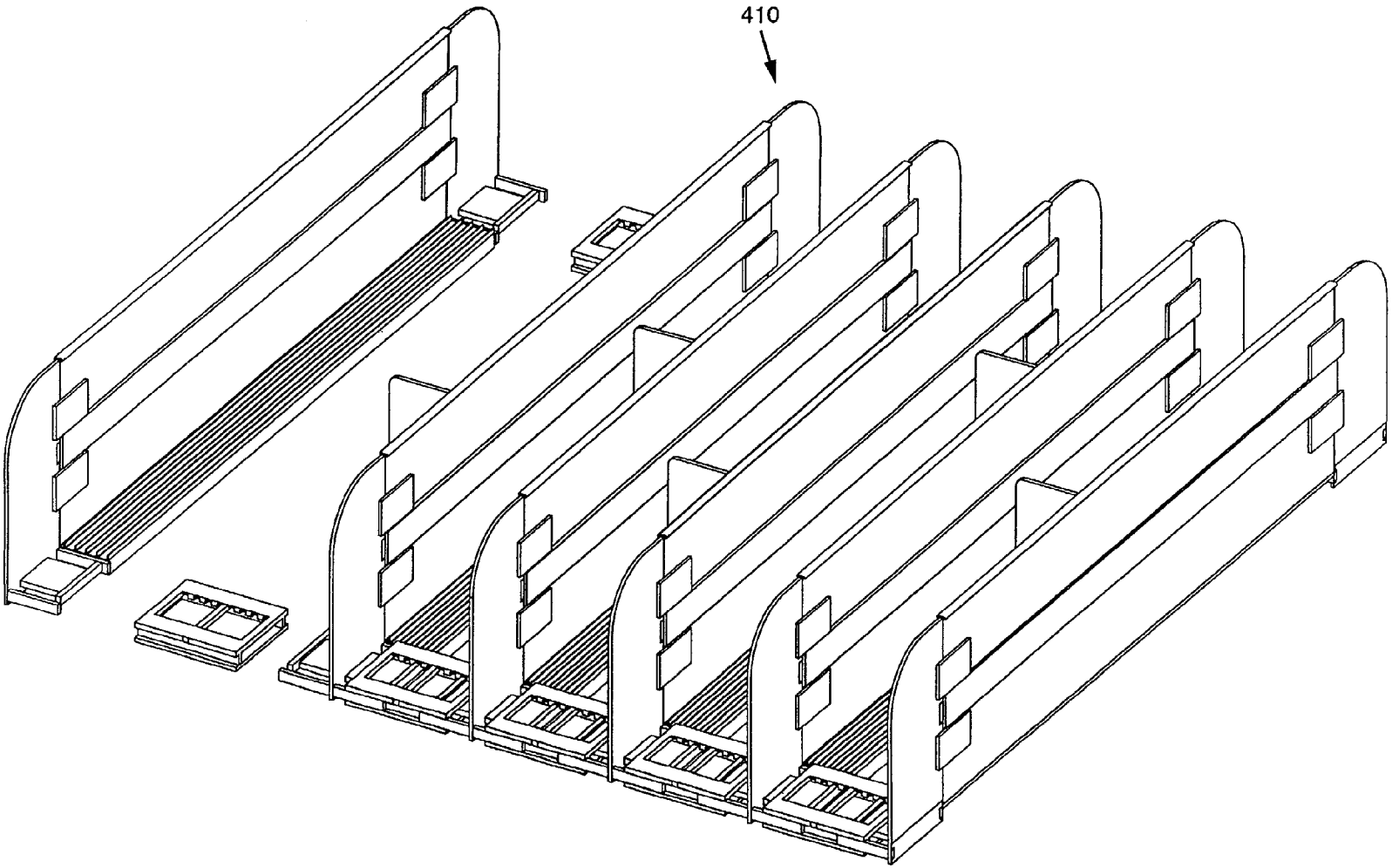
FIG. 29 is a partial exploded view of a merchandising system according to the third exemplary embodiment.
Figure 30:
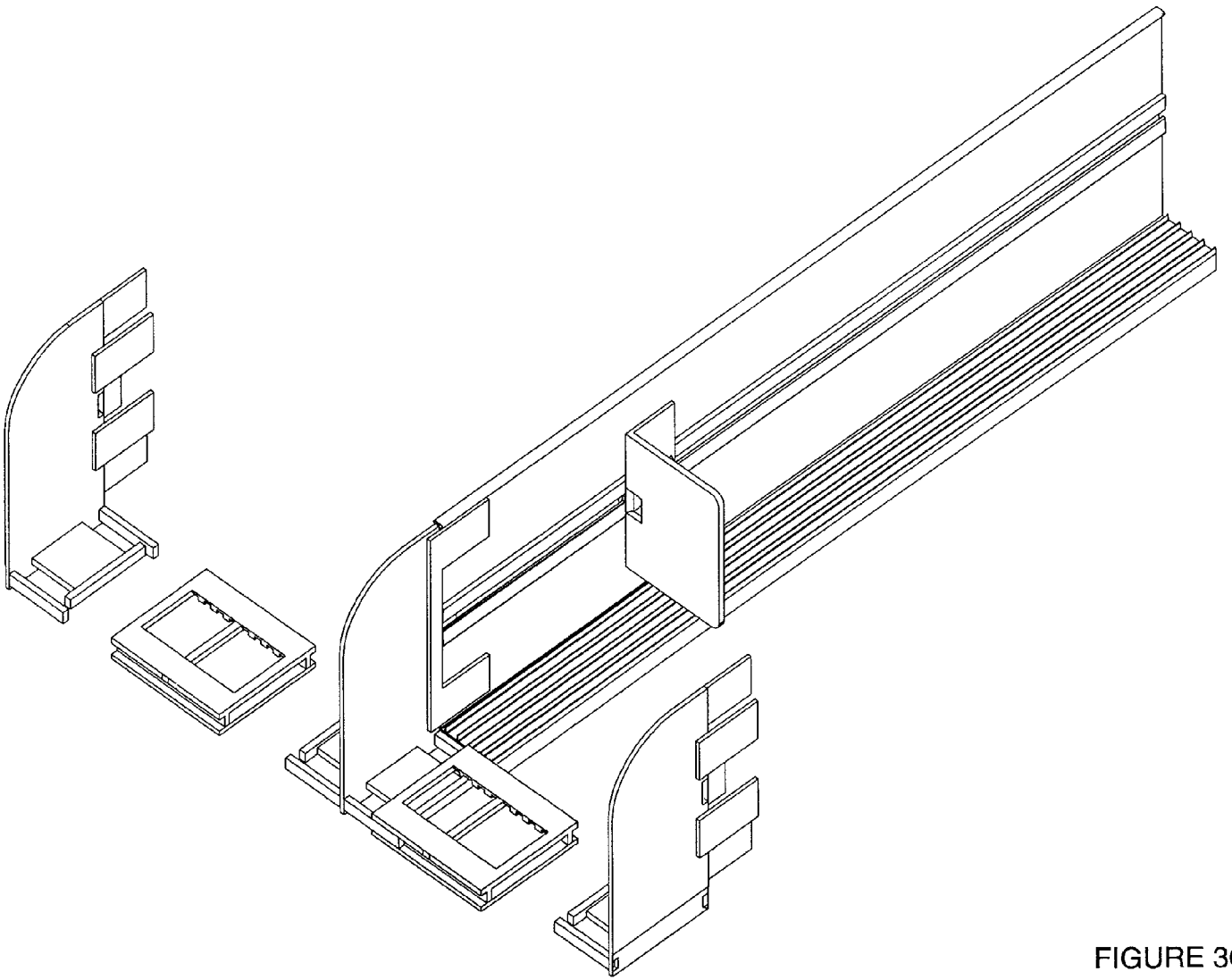
FIG. 30 is a partial exploded view of a merchandising system according to the third exemplary embodiment.

Frame section 424, and thus divider 420, are adjusted as follows. Flange 426 (with projections 428) is actuated by being depressed, (e.g. bent or deformed) to a deformed form to disengage projections 428 from gaps 444 on connector 440. Divider 420 is then free to move along or slide relative to connector 440 in guides 472 formed in frame section 424, as well as within recess or opening 452 in connector 440 (i.e. the space between base 432 and cover 430). Member 488 may move along guide 472 to promote alignment or to guide movement of divider 420. Access to flange 426 of frame section 424 to be actuated (e.g. deformed) is through an opening 454 in cover 430 of connector 440. Once frame section 424 (and divider 420) is moved to a desired location, flange 426 is released and allowed to return to its original form in which projections 428 again engage corresponding gaps 444 of connector 440. Flange 426 on frame section 424 will coact with gaps 444 on connector 440 to secure dividers 420 in a chosen position. As shown in FIGS. 24 and 25, adjustment of the width of a first facing (W1) may be done independently of the adjustment of the width of a second facing (W2).

The merchandising systems shown in the various exemplary and alternative embodiments provides for certain advantages. For example, the merchandising system shown in the various exemplary and alternative embodiments provides for the selective width adjustment of a chosen display "facing" without the need to resize adjacent facing widths. If a user need to resize one facing (for example, by replacing one sized product with another sized product), only that one facing will need to be adjusted. Adjacent facings (which may not require a width adjustment) will not need to be resized in order to compensate for the first facing adjustment.

Another such advantage is that the design of the dividers and connectors allow for relatively simple and convenient construction and assembly. Dividers may be constructed or assembled using simple extrusion methods, as opposed to a more costly injection molding process, which may also reduce production times, etc.

Another advantage is that connectors may be provided toward the front of the merchandising system (and thus toward the front of shelf 80). This configuration provides for relatively easier adjustment. A user who may have to adjust the spacings of a product facing will only have to connect and disconnect pieces which are located toward the front of the shelf, instead of pieces which may be located at a potentially more inconvenient location, such as the back of the shelf. Alternatively, one or two or more connectors may be provided along the length of the dividers to provide increased rigidity, stiffness, or strength for the merchandising system.

It is also important to note that the construction and arrangement of the elements of the merchandising system as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes, tolerances, and proportions of the various elements, values of parameters, mounting arrangements, use of materials, colors, orientations, etc.) without materially departing from the novel teachings and advantages of the subject matter of the present inventions. For example, elements shown as integrally formed may be constructed of multiple parts or elements show as multiple parts may be integrally formed. For example, a connector or connector portion of any of the exemplary or alternative embodiments could be made as an integral piece with a divider (see FIG. 38). The operation of the connection between the divider and connector may be reversed or otherwise varied, the shape or size (e.g. length or width) of the dividers or other elements of the system (e.g. shelf divider or interface of the divider members) may be varied, the nature or number of discrete adjustment positions provided on the connectors may be varied (e.g. by variations in the number of engagement points or size of the engagement points or type of engagement). (Also as example see FIGS. 33 through 38 providing alternate arrangements of dividers and connectors.)

It should be noted that the elements and/or assemblies of the system may be constructed from any of a wide variety of materials that provide sufficient strength or durability, including any of a wide variety of moldable or extrudable plastic materials (such as high-impact plastic) in any of a wide variety of colors, textures and combinations. It should also be noted that the merchandising system may be used in association with a shelf (e.g. of a shelving unit or the like) or any of a wide variety of other surfaces in any of a wide variety of other applications. Accordingly, all such modifications are intended to be included within the scope of the present inventions.

The merchandising system may be to display and merchandise a variety of products, including containers, packages, bags, boxes, tubes, etc. The products may be food products, foodstuffs, snacks, prepared food packages, etc. Alternatively, other products of a variety of sizes and weights may be displayed and merchandised, such as consumer products, parts, batteries, automotive batteries, tissue boxes, etc.

Other substitutions, modifications, changes and omissions may be made in the design, operating conditions and arrangement of the preferred and other exemplary embodiments without departing from the spirit of the present inventions.

What is claimed is:

1. A merchandising system configured to form a compartment comprising:

a first divider comprising at least one projection;

a second divider comprising at least one projection;

a first connector configured to couple the first divider to the second divider;

wherein the first connector comprises at least a first groove, a second groove and a third groove;

so that (a) the compartment is configured to be formed with a first size by pressing the projection of the first divider into engagement with the first groove of the first connector and by pressing the projection of the second divider into engagement with the second groove of the first connector and (b) the compartment is configured to be formed with a second size with the projection of the first divider in engagement with the first groove of the first connector by separating the projection of the second divider from the second groove of the first connector and by pressing the projection of the second divider into engagement with the third groove of the first connector;

wherein pressing a projection into engagement with a groove comprises inserting the projection into the groove from a direction generally transverse a longitudinal axis of the groove.

2. The merchandising system of claim 1 wherein the plurality of grooves comprise exposed grooves.

3. The merchandising system of claim 1 wherein the first connector comprises teeth.

4. The merchandising system of claim 3 wherein the first connector comprises notches.

5. The merchandising system of claim 4 wherein the plurality of grooves comprise channels.

6. The merchandising system of claim 1 wherein the first connector comprises an interface.

7. The merchandising system of claim 6 wherein the interface comprises a connector selected from a set of multi-sized connectors.

8. The merchandising system of claim 1 wherein the first connector is integrally formed.

9. The merchandising system of claim 8 wherein the first connector is configured to be cut to a desired length.

10. The merchandising system of claim 8 wherein the projection of the first divider is configured to be snapped into at least one of the first groove, the second groove and the third groove of the first connector.

11. The merchandising system of claim 1 wherein pressing comprises a snap fit of the projections of the dividers into engagement with the grooves of the first connector.

12. The merchandising system of claim 1 wherein pressing comprises a friction fit of the projections of the dividers into engagement with the grooves of the first connector.

13. The merchandising system of claim 1 wherein pressing comprises an interference fit of the projection of the first divider into engagement with the first groove of the first connector.

14. A merchandising system configured to form at least a first compartment and a second compartment comprising:

a first divider comprising at least one projection;

a second divider comprising at least a first projection and a second projection;

a third divider comprising at least one projection;

a first connector configured to couple the first divider to the second divider; and a second connector configured to couple the second divider to the third divider;

wherein the first connector comprises at least a first groove, a second groove and a third groove; and wherein the second connector comprises at least a first groove, a second groove and a third groove;

so that (a) the first compartment is configured to be formed with a first size by pressing the projection of the first divider into engagement with the first groove of the first connector and by pressing the first projection of the second divider into engagement with the second groove of the first connector and (b) the first compartment is configured to be formed with a second size with the projection of the first divider in engagement with the first groove of the first connector by separating the first projection of the second divider from the second groove of the first connector and by pressing the first projection of the second divider into engagement with the third groove of the first connector; and so that (a) the second compartment is configured to be formed with a first size by pressing the projection of the third divider into engagement with the first groove of the second connector and by pressing the second projection of the second divider into engagement with the second groove of the second connector and (b) the second compartment is configured to be formed with a second size with the projection of the third divider in engagement with the first groove of the second connector by separating the projection of the second divider from the second groove of the second connector and by pressing the second projection of the second divider into engagement with the third groove of the second connector;

wherein pressing a projection into engagement with a groove comprises inserting the projection into the groove from a direction generally transverse a longitudinal axis of the groove.

15. The merchandising system of claim 14 wherein the grooves comprise straight grooves.

16. The merchandising system of claim 14 wherein the grooves comprise cuts.

17. The merchandising system of claim 14 wherein the plurality of grooves comprise exposed grooves.

18. The merchandising system of claim 17 wherein the dividers and the connectors comprise a plastic polymer.

19. The merchandising system of claim 14 wherein the connectors comprise flat elongated members.

20. The merchandising system of claim 14 wherein the connectors comprise webs.

21. The merchandising system of claim 14 wherein the connectors comprise mats.

22. The merchandising system of claim 14 wherein the plurality of grooves comprise a series of grooves.

23. The merchandising system of claim 22 wherein the plurality of grooves comprise an index of grooves.

24. The merchandising system of claim 14 further comprising a pusher system provided on at least one of the dividers.

25. The merchandising system of claim 24 wherein the pusher system comprises a pusher face.

26. The merchandising system of claim 25 wherein the pusher system is configured to be urged toward a front edge of at least one of the dividers.

27. The merchandising system of claim 26 wherein the pusher system further comprises a biasing element configured to urge the pusher face toward the front edge of the merchandising system.

28. The merchandising system of claim 27 wherein the biasing element comprises a spring.

29. The merchandising system of claim 28 further comprising a slot provided on at least one of the dividers, wherein the pusher face is configured to move along the slot.

30. The merchandising system of claim 29 wherein the dividers further comprise divider panels.

31. The merchandising system of claim 30 wherein the dividers further comprise a product support surface.

32. The merchandising system of claim 31 wherein the product support surface comprises one or more friction reducing ribs.

33. A merchandising system configured to form a compartment comprising:

a first divider comprising at least one projection;

a second divider comprising at least one projection; and a first interface configured to couple the first divider to the second divider;

wherein the first interface comprises at least a first groove, a second groove and a third groove;

so that (a) the compartment is configured to be formed with a first size by pressing the projection of the first divider into engagement with the first groove of the first interface and by pressing the projection of the second divider into engagement with the second groove of the first interface and (b) the compartment is configured to be formed with a second size with the projection of the first divider in engagement with the first groove of the first interface by separating the projection of the second divider from the second groove of the first interface and by pressing the projection of the second divider into engagement with the third groove of the first interface;

wherein pressing a projection into engagement with a groove comprises inserting the projection into the groove from a direction generally transverse a longitudinal axis of the groove.

34. The merchandising system of claim 33 wherein the grooves comprise exposed grooves.

35. The merchandising system of claim 34 wherein the first interface comprises a connector.

36. The merchandising system of claim 35 wherein the connector is integrally formed.

37. The merchandising system of claim 36 wherein the connector comprises a flat elongated member.

38. The merchandising system of claim 37 wherein the first interface comprises teeth.

39. The merchandising system of claim 38 wherein the grooves are formed between adjacent notches.

40. The merchandising system of claim 33 wherein pressing comprises a snap fit of the projections of the dividers into engagement with the grooves of the first interface.

41. The merchandising system of claim 33 wherein pressing comprises a friction fit of the projections of the dividers into engagement with the grooves of the first interface.

42. The merchandising system of claim 41 wherein pressing comprises an interference fit of the projections of the dividers into engagement with the grooves of the first interface.

43. A merchandising system configured to form at least a first compartment and a second compartment comprising:

a first panel comprising at least one projection;

a second panel comprising at least a first projection and a second projection;

a third panel comprising at least one projection;

a first interface configured to couple the first panel to the second panel; and a second interface configured to couple the second panel to the third panel;

wherein the first interface comprises at least a first groove, a second groove and a third groove; and wherein the second interface comprises at least a first groove, a second groove and a third groove;

so that (a) the first compartment is configured to be formed with a first size by pressing the projection of the first panel into engagement with the first groove of the first interface and by pressing the first projection of the second panel into engagement with the second groove of the first interface and (b) the first compartment is configured to be formed with a second size with the projection of the first panel in engagement with the first groove of the first interface by separating the first projection of the second panel from the second groove of the first interface and by pressing the first projection of the second panel into engagement with the third groove of the first interface; and so that (a) the second compartment is configured to be formed with a first size by pressing the projection of the third panel into engagement with the first groove of the second interface and by pressing the second projection of the second panel into engagement with the second groove of the second interface and (b) the second compartment is configured to be formed with a second size with the projection of the third panel in engagement with the first groove of the second interface by separating the projection of the second panel from the second groove of the second interface and by pressing the second projection of the second panel into engagement with the third groove of the second interface;

wherein pressing a projection into engagement with a groove comprises inserting the projection into the groove from a direction generally transverse a longitudinal axis of the groove.

44. The merchandising system of claim 43 wherein each interface comprises a connector.

45. The merchandising system of claim 44 wherein the connectors are integrally formed.

46. The merchandising system of claim 45 wherein the plurality of grooves comprise exposed grooves.

47. The merchandising system of claim 45 wherein each groove comprises a cut.

48. The merchandising system of claim 45 wherein each connector comprises a flat elongated member.

49. The merchandising system of claim 48 wherein each groove comprises a channel.

50. The merchandising system of claim 43 wherein pressing comprises a snap fit of the projections of the panels into engagement with the grooves of the interfaces.

51. The merchandising system of claim 43 wherein the plurality of grooves comprise a series of grooves.

52. The merchandising system of claim 43 wherein the plurality of grooves comprise an index of grooves.

53. The merchandising system of claim 43 wherein the first divider has a length greater than a length of the first interface.

54. The merchandising system of claim 53 wherein the first interface is a connector module.

55. A merchandising system configured to form a compartment comprising:

a first divider comprising at least one projection;

a second divider comprising at least one projection; and a first interface configured to couple the first divider to the second divider;

wherein the first interface comprises at least a first channel, a second channel and a third channel;

so that (a) the compartment is configured to be formed with a first size by pressing the projection of the first divider into engagement with the first channel of the first interface and by pressing the projection of the second divider into engagement with the second channel of the first interface and (b) the compartment is configured to be formed with a second size with the projection of the first divider in engagement with the first channel of the first interface by separating the projection of the second divider from the second channel of the first interface and by pressing the projection of the second divider into engagement with the third channel of the first interface;

wherein pressing a projection into engagement with a groove comprises inserting the projection into the groove from a direction generally transverse a longitudinal axis of the groove.

56. The merchandising system of claim 55 wherein the plurality of exposed channels comprise a plurality of grooves.

57. The merchandising system of claim 56 wherein the plurality of grooves comprise a series of grooves.

58. The merchandising system of claim 56 wherein the plurality of grooves comprise an index of grooves.

59. The merchandising system of claim 55 wherein the first interface comprises a connector module.

60. The merchandising system of claim 55 wherein pressing comprises a friction fit of the projections of the dividers into engagement with the channels of the first interface.

61. The merchandising system of claim 55 wherein pressing comprises an interference fit of the projections of the dividers into engagement with the channels of the first interface.

62. The merchandising system of claim 55 wherein the first interface is a flat elongated member.

63. The merchandising system of claim 55 further comprising a pusher system provided on at least one of the dividers and comprising a biasing member and a pusher, wherein the biasing element is coupled to the pusher and urges the pusher toward a front of the merchandising system.

64. A merchandising system configured to form at least a first compartment and a second compartment comprising:

a first panel comprising at least one projection;

a second panel comprising at least a first projection and a second projection;

a third panel comprising at least one projection;

a first interface configured to couple the first panel to the second panel;

a second interface configured to couple the second panel to the third panel;

wherein the first interface comprises at least a first groove, a second groove and a third groove; and wherein the second interface comprises at least a first groove, a second groove and a third groove;

so that (a) the first compartment is configured to be formed with a first size by pressing the projection of the first panel into engagement with the first groove of the first interface and by pressing the first projection of the second panel into engagement with the second groove of the first interface and (b) the first compartment is configured to be formed with a second size with the projection of the first panel in engagement with the first groove of the first interface by separating the first projection of the second panel from the second groove of the first interface and by pressing the first projection of the second panel into engagement with the third groove of the first interface; and so that (a) the second compartment is configured to be formed with a first size by pressing the projection of the third panel into engagement with the first groove of the second interface and by pressing the second projection of the second panel into engagement with the second groove of the second interface and (b) the second compartment is configured to be formed with a second size with the projection of the third panel in engagement with the first groove of the second interface by separating the projection of the second panel from the second groove of the second interface and by pressing the second projection of the second panel into engagement with the third groove of the second interface;

wherein pressing a projection into engagement with a groove comprises inserting the projection into the groove from a direction generally transverse a longitudinal axis of the groove.

65. The merchandising system of claim 64 wherein the plurality of grooves comprise exposed grooves.

66. The merchandising system of claim 64 wherein the first interface comprises teeth.

67. The merchandising system of claim 64 wherein the first interface comprises notches.

68. The merchandising system of claim 64 wherein the plurality of grooves comprise channels.

69. The merchandising system of claim 64 wherein the first interface comprises a connector.

70. The merchandising system of claim 69 wherein the first interface comprises a connector selected from a set of multi-sized connectors.

71. The merchandising system of claim 64 wherein the first interface is integrally formed.

72. The merchandising system of claim 64 wherein the first interface is configured to be cut to a desired length.

73. The merchandising system of claim 64 wherein the at least one projection of the first panel is configured to be snapped into the plurality of grooves of the first interface.

74. The merchandising system of claim 64 wherein pressing comprises a snap fit of the projections of the panels into engagement with the grooves of at least one of the interfaces.

75. The merchandising system of claim 64 wherein pressing comprises a friction fit of the projections of the panels into engagement with the grooves of at least one of the interfaces.

76. The merchandising system of claim 64 wherein pressing comprises an interference fit of the projections of the panels into engagement with the grooves of at least one of the interfaces.

77. A merchandising system configured to form at least a first compartment and a second compartment comprising:

a first panel comprising at least one projection;

a second panel comprising at least a first projection and a second projection;

a third panel comprising at least one projection;

a first connector configured to couple the first panel to the second panel;

a second connector configured to couple the second panel to the third panel;

wherein the first connector comprises at least a first groove, a second groove and a third groove; and wherein the second connector comprises at least a first groove, a second groove and a third groove;

so that (a) the first compartment is configured to be formed with a first size by pressing the projection of the first panel into engagement with the first groove of the first connector and by pressing the first projection of the second panel into engagement with the second groove of the first connector and (b) the first compartment is configured to be formed with a second size with the projection of the first panel in engagement with the first groove of the first connector by separating the first projection of the second panel from the second groove of the first connector and by pressing the first projection of the second panel into engagement with the third groove of the first connector; and so that (a) the second compartment is configured to be formed with a first size by pressing the projection of the third panel into engagement with the first groove of the second connector and by pressing the second projection of the second panel into engagement with the second groove of the second connector and (b) the second compartment is configured to be formed with a second size with the projection of the third panel in engagement with the first groove of the second connector by separating the projection of the second panel from the second groove of the second connector and by pressing the second projection of the second panel into engagement with the third groove of the second connector;

wherein pressing a projection into engagement with a groove comprises inserting the projection into the groove from a direction generally transverse a longitudinal axis of the groove.

78. The merchandising system of claim 77 wherein each of the panels comprise dividers.

79. The merchandising system of claim 78 wherein the connectors comprise interfaces.

80. The merchandising system of claim 78 wherein the connectors comprise teeth.

81. The merchandising system of claim 78 wherein the grooves are formed between adjacent notches.

82. The merchandising system of claim 78 wherein the first connector is integrally formed.

83. The merchandising system of claim 78 wherein pressing comprises a snap fit of the projections of the panels into engagement with the grooves of the connectors.

84. The merchandising system of claim 78 wherein the grooves comprise straight grooves.

85. The merchandising system of claim 78 further comprising a pusher system provided on at least one of the panels and comprising a biasing member and a pusher, wherein the biasing element is coupled to the pusher and urges the pusher toward a front of the merchandising system.

* * * * *